US007526069B2

(12) United States Patent
Matsumura et al.

(10) Patent No.: US 7,526,069 B2
(45) Date of Patent: Apr. 28, 2009

(54) X-RAY TUBE

(75) Inventors: Tatsuya Matsumura, Hamamatsu (JP); Tomoyuki Okada, Hamamatsu (JP); Tooru Yamamoto, Hamamatsu (JP); Hidetsugu Takaoka, Hamamatsu (JP); Tetsuro Endo, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 187 days.

(21) Appl. No.: 10/571,996

(22) PCT Filed: Sep. 15, 2004

(86) PCT No.: PCT/JP2004/013446

§ 371 (c)(1), (2), (4) Date: Mar. 15, 2006

(87) PCT Pub. No.: WO2005/029531

PCT Pub. Date: Mar. 31, 2005

(65) Prior Publication Data

US 2006/0280290 A1 Dec. 14, 2006

(30) Foreign Application Priority Data

Sep. 16, 2003 (JP) ..... 2003-323461
Sep. 16, 2003 (JP) ..... 2003-323534

(51) Int. Cl.
*H01J 5/18* (2006.01)

(52) U.S. Cl. ..... 378/140; 378/119; 378/121; 378/161

(58) Field of Classification Search ..... 378/161, 378/140, 119, 121
See application file for complete search history.

(56) References Cited

U.S. PATENT DOCUMENTS

| | | | | | |
|---|---|---|---|---|---|
| 4,119,855 | A | * | 10/1978 | Bernacki | 378/34 |
| 4,632,871 | A | * | 12/1986 | Karnezos et al. | 428/336 |
| 4,862,490 | A | * | 8/1989 | Karnezos et al. | 378/161 |
| 5,039,203 | A | * | 8/1991 | Nishikawa | 359/894 |
| 5,111,493 | A | | 5/1992 | Siedband | |
| 5,161,179 | A | * | 11/1992 | Suzuki et al. | 378/161 |
| 6,044,130 | A | | 3/2000 | Inazura et al. | 378/138 |
| 6,487,272 | B1 | * | 11/2002 | Kutsuzawa | 378/140 |
| 2003/0185344 | A1 | * | 10/2003 | Ukita | 378/143 |

FOREIGN PATENT DOCUMENTS

| | | |
|---|---|---|
| JP | 1-276550 | 11/1989 |
| JP | 3-105300 | 5/1991 |
| JP | 7-45223 | 2/1995 |
| JP | 7-294700 | 11/1995 |
| JP | 9-180660 | 7/1997 |

(Continued)

*Primary Examiner*—Edward J Glick
*Assistant Examiner*—Mona M Sanei
(74) *Attorney, Agent, or Firm*—Drinker Biddle & Reath LLP

(57) ABSTRACT

The present invention relates to an X-ray tube capable of efficiently extracting X-rays of low energy and provided with a structure having excellent durability. The X-ray tube is provided with a silicon foil having a thickness of 3 μm or more but 30 μm or less as a part of a vessel body. The silicon foil is directly or indirectly affixed on the closed vessel in a state that the silicon foil covers the opening provided in the closed vessel, and functions as a transmission window of the closed vessel.

17 Claims, 18 Drawing Sheets

FOREIGN PATENT DOCUMENTS

| | | |
|---|---|---|
| JP | 11-87088 | 3/1999 |
| JP | 2951477 | 7/1999 |
| JP | 2000-306533 | 11/2000 |
| JP | 2001-059900 | 3/2001 |
| JP | 2001-319605 | 11/2001 |
| JP | 2003-131000 | 5/2003 |

* cited by examiner (a)

(b)

(c)

(a)

(b)

(a)

(b)

(a)

(b)

(a)

(b)

(c)

(a)

(b)

X-RAY TUBE

TECHNICAL FIELD

The present invention relates to an X-ray tube for emitting X-rays, and particularly an X-ray tube provided with a structure suitable for a static elimination device for irradiating the X-rays into air or gas to generate ion gas.

BACKGROUND ART

A process for statically eliminating a charged body by an ionized gas stream has been conventionally performed. Ion gas used for the static elimination is generated by irradiating the X-rays into air or gas. Referring to an X-ray tube for emitting the X-rays, the X-ray tube using beryllium having excellent X-ray transmittance has been known as a transmission window material used for a transmission window for extracting the X-rays from the X-ray tube (Patent Document 1), and the X-ray tube is incorporated in a static elimination device or the like.

The attachment of the transmission window made of beryllium is performed by once reinforcing the transmission window using a metal ring and by attaching the metal ring to a glass vessel body (Patent Document 2). A beryllium plate as the transmission window and the metal ring are adhered by heating the beryllium plate, the metal ring and a brazing material with the beryllium plate on the metal ring via the brazing material (Patent Document 3).

Patent Document 1: Patent Application No. 2951477

Patent Document 2: Japanese Patent Application Laid-Open No. 2000-306533

Patent Document 3: Japanese Patent Application Laid-Open No. 2001-59900

DISCLOSURE OF THE INVENTION

Problem to be Solved by the Invention

The present inventors have studied the conventional X-ray tube in detail and as a result, have discovered the following problems. Namely, the conventional X-ray tube has used beryllium having excellent X-ray transmittance as a transmission window material. The beryllium is a harmful substance specified as specified chemical substances. Therefore, manufacturers have been burdened with the recovery duty of vessels even when products are discarded in life end so as to reduce adverse influences to a use environment. The problems relating to environmental friendliness are solved by stopping the use of the beryllium as the transmission window material of the X-ray tube, however, under present circumstances, there is no material suitable as a material having a thickness capable of maintaining vacuum airtightness and having excellent X-ray transmittance, and the beryllium must be used out of need.

Since it is difficult for the conventional beryllium transmission window to extract the X-rays of low energy of approximately 1 to 2 keV selectively and efficiently, and the X-rays of higher energy are also easily emitted, the beryllium may affect the human body when the conventional beryllium transmission window is used for the static elimination device or the like.

In addition, it is necessary to reduce the thickness of the transmission window so as to extract the X-rays of low energy. In this case, even when the transmission window has sufficient strength for constituting a part of the closed vessel, a crack may be generated on the transmission window itself by the influence or the like of irregularity on the surface of the brazing material when the transmission window is adhered on a part of the closed vessel (the metal ring in the Patent Document 2) via the brazing material, thereby it may not function as a transmission window. Further, even if a crack is not generated, sufficient durability is not obtained when distortion is generated on the transmission window.

The present invention has been made to solve the above problems. It is an object of the present invention to provide an X-ray tube capable of efficiently extracting the X-rays of low energy without using harmful beryllium and provided with a structure having excellent durability.

Means for Solving Problem

An X-ray tube according to the present invention is directed to an X-ray for emitting X-rays via a transmission window, and has a structure suitable for a static elimination device or the like particularly for irradiating the X-rays into air or gas to generate ion gas.

Specifically, the X-ray tube according to the present invention comprises, at least, a closed vessel, an electron source, an X-ray target, and a silicon foil having a thickness of 3 μm or more but 30 μm or less, preferably of 3 μm or more but 10 μm or less. The closed vessel comprises an opening for defining a transmission window. The electron source is arranged in the closed vessel, and emits electrons toward an X-ray target. The X-ray target receives the electrons emitted from the electron source and generates X-rays.

In particular, in the X-ray tube according to the present invention, the silicon foil is directly affixed on a part of the closed vessel defining the opening while covering the opening of the closed vessel. Herein, the silicon foil has a thickness of 30 μm or less, preferably of 10 μm or less so as to obtain the X-rays of a desired energy. However, the silicon foil itself is a very flexible material. Consequently, in the X-ray tube according to the present invention, a part of the closed vessel functions as a reinforcing member of the silicon foil by directly affixing the silicon foil on a part of the closed vessel defining the opening. On the other hand, the silicon foil functions as a part of the closed vessel, and maintains the vacuum airtightness of the closed vessel. For example, when the silicon foil is adhered on the closed vessel via the brazing material as in the conventional method, a crack is generated on the silicon foil itself by the influence or the like of irregularity of the surface of the brazing material. Thereby, the vacuum airtightness of the closed vessel cannot be maintained, and the silicon foil may not function as the transmission window. Sufficient durability is not obtained when distortion is generated on the silicon foil even when a crack is not generated. Consequently, in the first embodiment, the closed vessel functions as the reinforcing member so that equivalent tension is imparted to the entire area of the silicon foil functioning as the transmission window by directly affixing silicon foil on the closed vessel (with the silicon foil directly contacted with the closed vessel). Thereby, sufficient durability is imparted to the X-ray tube.

Referring to the affixing of the silicon foil to the metal part constituting a part of the closed vessel, it is preferable to cover the peripheral part of the silicon foil and the metal part together by the brazing material. It is preferable that the silicon foil is affixed to the glass faceplate constituting a part of the closed vessel (faceplate part) and a part of the closed vessel by an anodic bonding.

When the anodic bonding is performed, the closed vessel in the X-ray tube according to the present invention contains the glass faceplate containing an alkaline ion and having an opening for defining the transmission window. When whole of the closed vessel body is made by a glass material, the glass faceplate may be a flat part of the glass body. The silicon foil is directly affixed on the glass faceplate by the anodic bonding with the opening of the glass faceplate covered. Herein, the silicon foil has a thickness of 30 μm or less, preferably 10 μm or less so as to obtain the X-rays of a desired energy. However, the silicon foil itself is a very flexible material. Consequently, in the X-ray tube according to the present invention, the glass faceplate functions as the reinforcing member of the silicon foil by directly affixing the silicon foil on the glass faceplate defining the opening. On the other hand, the silicon foil functions as a part of the closed vessel, and maintains the vacuum airtightness of the closed vessel. For example, when the thin silicon foil is thus adhered on a part of the closed vessel via the brazing material as in the conventional method, a crack is generated on the silicon foil itself by the influence or the like of the irregularity of the surface of the brazing material. Thereby, the vacuum airtightness of the closed vessel cannot be maintained, and silicon foil may not function as a transmission window. Sufficient durability is not obtained when distortion is generated on the silicon foil even when a crack is not generated. Therefore, in the present invention, the glass faceplate containing the alkaline ion is prepared for a part of the closed vessel, and the silicon foil is directly affixed on the glass faceplate by the anodic bonding (with the silicon foil directly contacted with the glass faceplate). Thereby, the closed vessel functions as the reinforcing member so that equivalent tension is imparted to the entire area functioning as the transmission window of the silicon foil. Thereby, sufficient durability is imparted to the X-ray tube.

A ultra-thin silicon foil having a thickness of approximately 3 μm or more but 10 μm or less has been comparatively inexpensively manufactured by improvement in the latest semiconductor techniques. FIG. 1 is a graph showing the X-ray transmission characteristics of silicon and beryllium. A graph G110 and a graph G120 show the X-ray transmittance of beryllium having a thickness of 500 μm and the X-ray transmittance of silicon having a thickness of 10 μm, respectively. As shown in FIG. 1, when the thickness of the silicon foil is reduced to approximately 10 μm, almost the same X-ray transmission characteristics as the beryllium having a thickness of 500 μm which has been mainly used conventionally can be obtained. On the other hand, the silicon having a thickness of 3 μm or more can be used as the X-ray transmission window also working as the seal of a vacuum closed vessel (sufficient strength is obtained as a part of the vacuum closed vessel under the present situation). In this case, the silicon can work as the transmission window material corresponding to beryllium having a thickness of approximately 200 μm in the X-ray transmittance. Herein, it should be noted that extra-soft X-rays of 1.84 keV or less as the X-ray absorption property (K absorption end) peculiar to the silicon element are efficiently emitted when the thickness of the silicon foil is reduced to 30 μm or less. This is a feature which is not in the beryllium, and when the X-ray tube to which the silicon is applied as the transmission window material is used for the static elimination application, since the ion generating rate of X-rays emitted is very high and the X-rays are absorbed into air by approximately 10 cm after being emitted into the air as described in the Patent Document 1, X-rays having high safety to the human body can be very efficiently extracted.

When the anodic bonding is performed, the size of the glass faceplate to which the silicon foil is attached causes a problem. Particularly, in the structure where the glass faceplate is attached on the closed vessel body, the peripheral part of the glass faceplate may be raised by heating at the time of attaching the glass faceplate. When the maximum outer diameter of the silicon foil is close to the minimum outer diameter of the glass faceplate at this time, the silicon foil tends to be affixed so that the silicon foil is bridged over the flat part of the glass faceplate and the raised peripheral part, and the peripheral part tends to be pushed up to the central area of the silicon foil. Therefore, a crack or uneven bonding may be generated. Therefore, it is preferable that the minimum outer diameter of the glass faceplate is sufficiently larger than the maximum outer diameter of the silicon foil affixed. However, even when the maximum outer diameter of the silicon foil is close to the minimum outer diameter of the glass faceplate, the glass faceplate may be processed so that the thickness of the sectional shape is reduced in a taper shape from the flat part around the part having the opening toward the peripheral part. In this case, even when the glass faceplate is heated and attached, the raising of the peripheral part is avoided, and the generation of a crack and uneven bonding of the silicon foil directly attached to the glass faceplate are eliminated.

Furthermore, the X-ray tube according to the present invention may has either of a transmission type structure or a reflection type structure. Since the X-ray target enables the miniaturization of the X-ray tube in the case of the transmission type X-ray tube, the X-ray target is preferably deposited on the surface of the silicon foil facing inside the closed vessel.

Since the silicon foil has a very thin thickness of 30 μm or less, a crack may be generated when the area of the opening formed on the glass faceplate is too large. Then, the transmission window having a substantially large area can be constituted by previously setting the area to be covered with the silicon foil to the structure divided into a plurality of sections having small areas. In particular, the opening of the closed vessel may have a mesh structure so that the transmission window is divided into a plurality of sections, and the opening of the glass faceplate may be a plurality of through-holes each corresponding to the transmission window.

As described above, in accordance with the present invention, the X-ray tube capable of extracting the X-rays of low energy efficiently can be obtained without using the harmful beryllium specified as the specified chemical substance by using the silicon foil having a predetermined thickness instead of the beryllium which has been conventionally used as the transmission window material of the X-ray tube. The X-ray tube which is less expensive than the conventional one can be manufactured by using the silicon foil.

Furthermore, since the silicon foil can be directly affixed on the metal part and glass faceplate constituting a part of the closed vessel for supporting the silicon foil with the silicon foil directly contacted by the brazing material or the anodic bonding, the generation of a distortion or crack is effectively suppressed, and the structure having excellent durability is obtained.

BEST MODES FOR CARRYING OUT THE INVENTION

Figure 1:
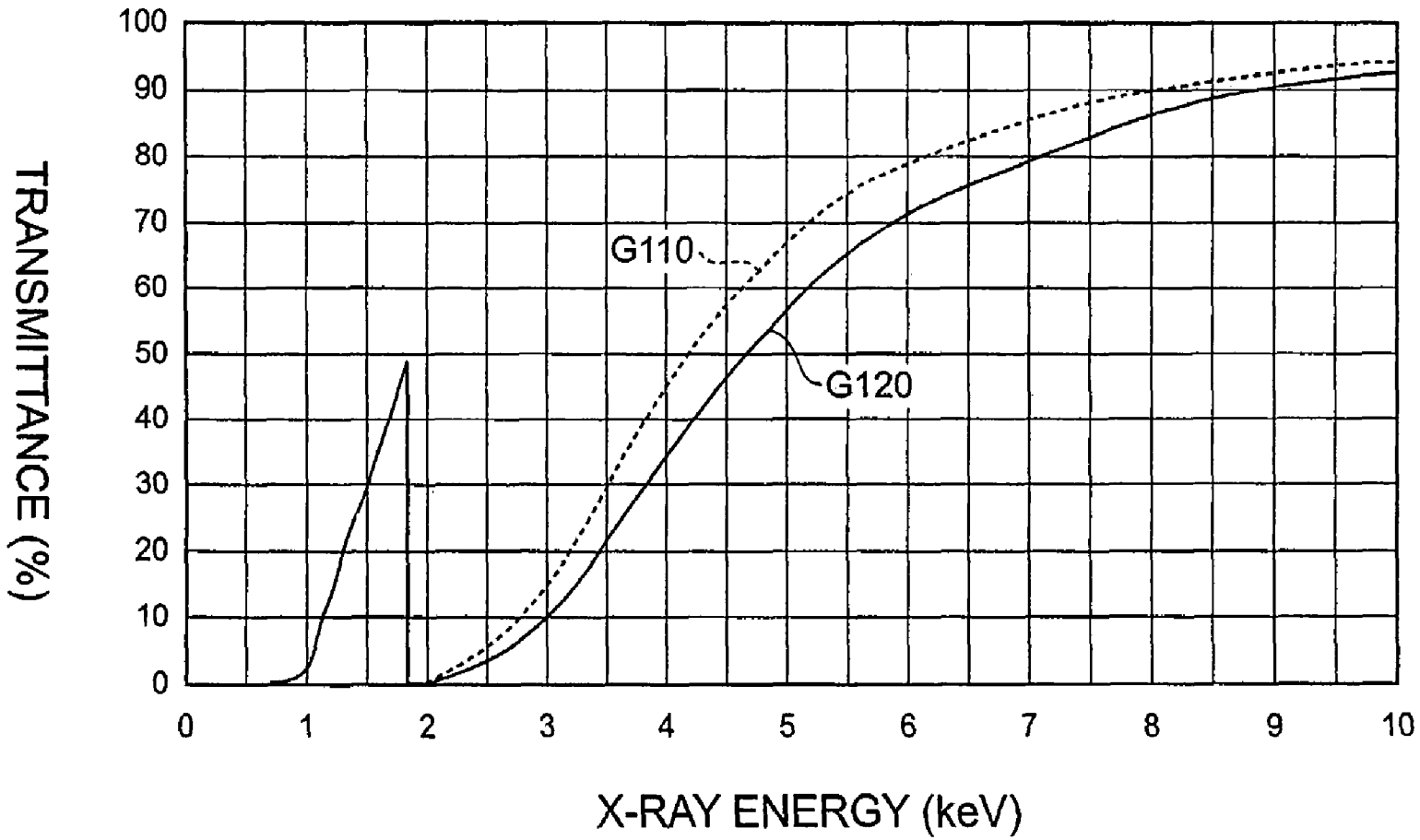
FIG. 1 is a graph showing X-ray transmissivities of silicon and berylium respectively.

Hereinafter, the embodiments of the X-ray tube according to the present invention will be described in detail using FIG. 2 to FIG. 18. In the description of the drawings, identical components are designated by the same reference numerals, and an overlapping description is omitted. In the following description, FIG. 1 previously described is also quoted as needed.

First Embodiment

Figure 2:
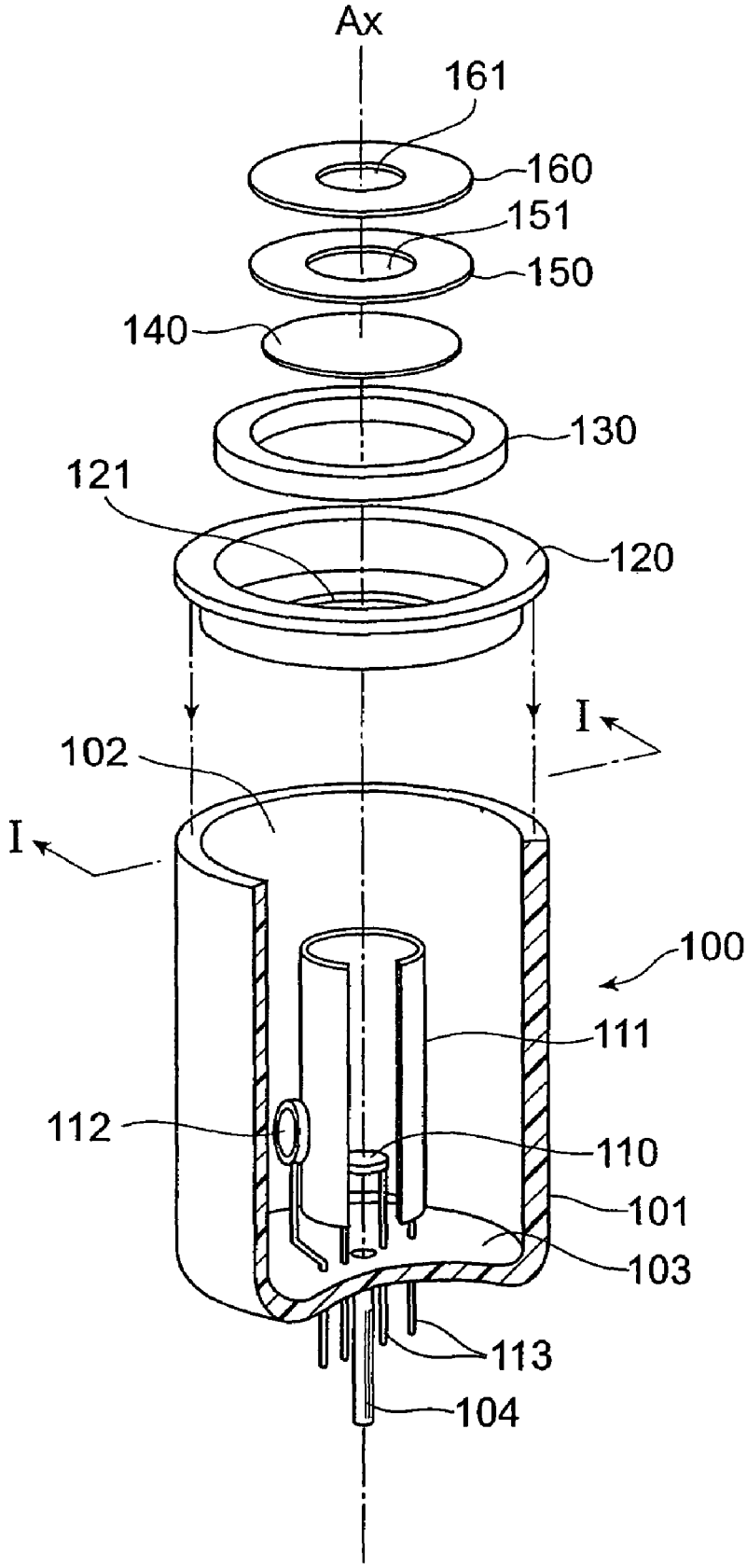
FIG. 2 is an assembly process chart showing the structure of a transmission type X-ray tube as a first embodiment of an X-ray tube according to the present invention.
Figure 3:
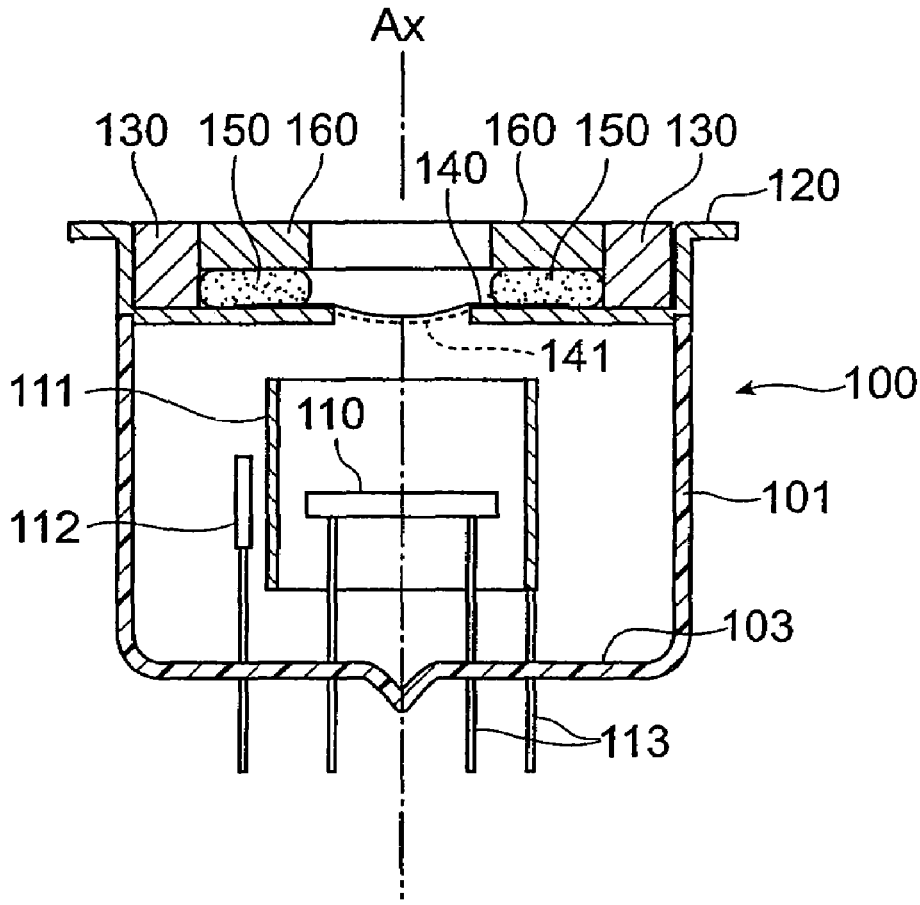
FIG. 3 is a view showing the sectional structure of the X-ray tube according to the first embodiment along the line I-I in FIG. 2.

First, the first embodiment in the X-ray tube according to the present invention will be described. FIG. 2 is an assembly process chart showing the structure of a transmission type X-ray tube as a first embodiment of an X-ray tube according to the present invention. FIG. 3 is a view showing the sectional structure of a transmission type X-ray tube 100 according to the first embodiment along the line I-I in FIG. 2.

The X-ray tube 100 according to the first embodiment is provided with a vessel body (glass vessel) 101 having an opening 102 and a metal flange 120 attached to the opening 102. An opening 121 for defining a transmission window is formed at the center of a hollow of the metal flange 120, and a metal ring 130 is inserted into the circumference of the hollow of the metal flange 120. Furthermore, a silicon foil 140, a brazing material 150 (thickness: approximately 100 μm), and a press electrode 160 (thickness: approximately 100 μm) are arranged in order of proximity to the metal flange 120 along an axis AX in the hollow of the metal flange 120. Openings 151 and 161 for exposing a part of the silicon foil 140 as the transmission window are respectively formed in the brazing material 150 and the press electrode 160.

In the first embodiment, the silicon foil 140 is affixed on the metal flange 120 with the silicon foil 140 directly contacted with the metal flange 120 by brazing so that the opening 121 is closed, and thereby the vacuum closed vessel is constituted by the vessel body 101, the metal flange 120 and the silicon foil 140.

There is provided a vacuum pipe 104 for vacuuming the closed vessel constituted by the vessel body 101, the metal flange 120 and the silicon foil 140 to form a vacuum closed vessel in the vessel body 101. An electron source 110, a focusing electrode 111 and a gas adsorption material 112 are arranged in the vessel body 101. Also, stem pins 113 penetrating a bottom part 103 for applying a predetermined voltage to the members and holding the members at a prescribed position in the vessel body 101 are arranged on a bottom part 103 of the vessel body 101.

An X-ray target 141 is deposited on the surface of the side facing inside the vacuum closed vessel of the silicon foil 140 affixed on the metal flange 120, more particularly the surface of the side facing inside the vacuum vessel of the portion of the silicon foil 140 substantially covering the opening 121. Therefore, the potentials of the metal flange 120, the silicon foil 140 and the target 141 become identical. For example, when the X-ray tube according to the first embodiment is used by setting the side of the X-ray target 141 to a GND potential, the metal flange 120 or the silicon foil 140 may be grounded via a conductive member. Not only a hot cathode electron source such as a conventional filament, but also a cold cathode electron source such as a carbon nanotube electron can be applied to the electron source 110 source when the X-ray tube itself is miniaturized.

In the first embodiment, the metal flange 120 having the hollow center is applied. The metal flange 120 to which the silicon foil 140 is previously affixed is attached to the vessel body 101 with the hollow stored in the vessel body 101. However, the method of attaching the metal flange is not limited to the first embodiment, and various methods can be used. For example, as shown in the area (a) of FIG. 4, a metal flange 120*a* having an opening 121*a* formed at the center of the hollow may be attached to the vessel body 101 so that the hollow is projected from the vessel body 101. It is not necessary for the metal flange to have a shape having the hollow center as the metal flange 120 in the first embodiment. For example, as shown in the area (b) of FIG. 4, the metal flange may be a disk-shaped metal flange 120*b* having an opening 121*b* formed at the center.

Figure 4:
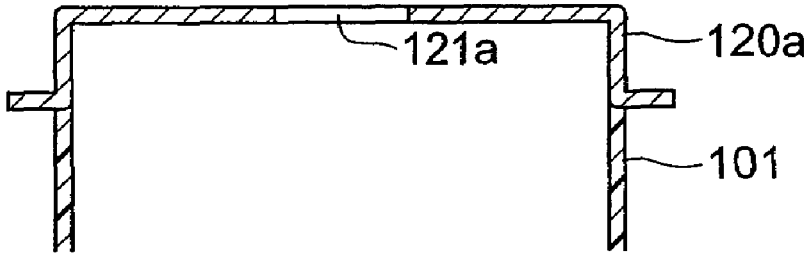
FIG. 4 are views for explaining a method of attaching a flange and other examples of the shape of the flange.
Figure 4:
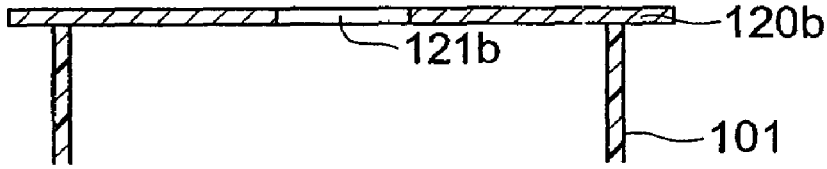
Figure 4:
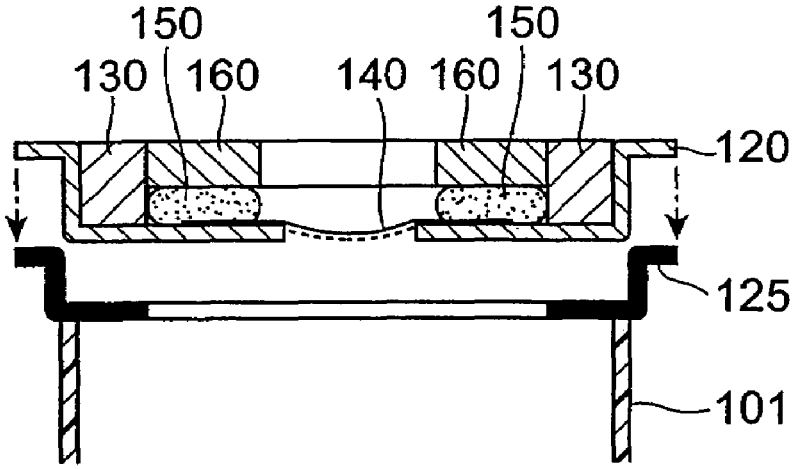

As shown in the area (c) of FIG. 4, another metal flange 125 is bonded to the opening 102 when bonding the metal flange 120 to the vessel body 101, and the peripheral part of the metal flange 120 and the peripheral part of another metal flange 125 may be welded and bonded. When the metal flange 120 is directly bonded to the vessel body 101, the metal flange 120 is usually heated. However, in this case, heat affects a transmission window structure member such as the silicon foil 140 attached to the metal flange 120 and the brazing material 150 (breakage due to the oxidization of the silicon foil 140, the difference in a coefficient of thermal expansion, and the dissolution of the brazing material 150, etc.).

On the other hand, when the peripheral parts of the metal flanges 120 and 125 are bonded to each other, the heat accompanying the bonding hardly affects the silicon foil 140 and the brazing material 150 or the like. The influence of the heat can be further reduced by cooling a part except the bonded part of the metal flange 120, particularly a transmission window by a metal block or the like when bonding.

Figure 5:
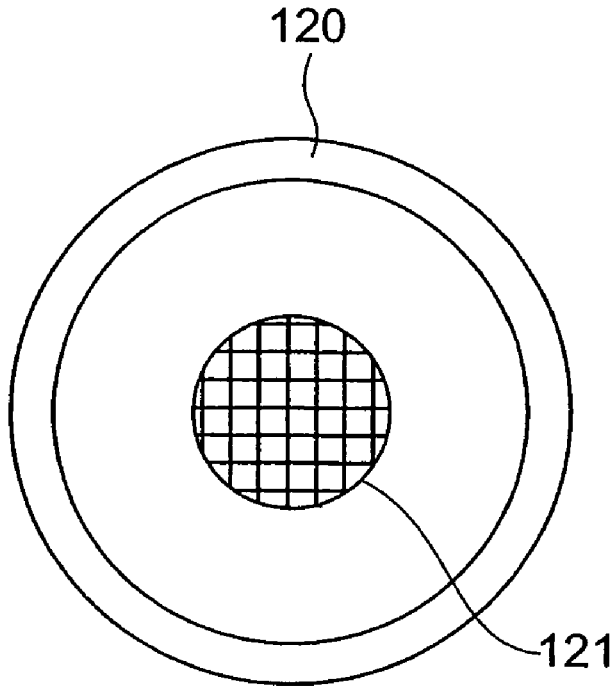
FIG. 5 are plan views showing various structures of a vessel opening for defining a transmission window.
Figure 5:
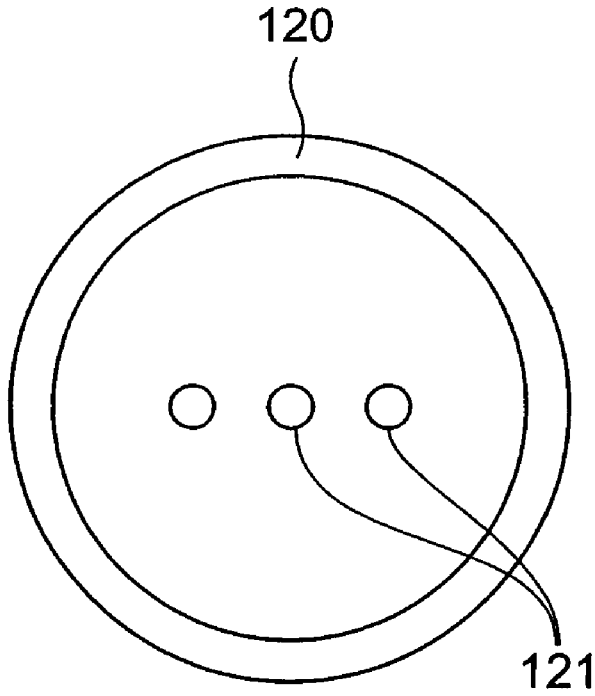

The silicon foil 140 applied to the transmission type X-ray tube 100 according to the first embodiment has a thickness of 30 μm or less, preferably of 10 μm or less. Thus, since the thickness of the silicon foil 140 is very thin, a crack may be generated when the area of the opening (corresponding to the opening 121 of the metal flange 120 in the first embodiment) formed in the closed vessel is too large. Specifically, when the large-area transmission window having a diameter of 10 mm or more is airtightly sealed by single silicon foil, the silicon foil is bent by a pressure differential between the inside and outside of the closed vessel, and a crack may be generated. This is based on the silicon foil itself lacking strength. Then, as shown in FIG. 5, it is preferable that the opening 121 of the metal flange 120 has a structure of which the transmission window is previously divided into a plurality of sections. For example, as shown in the are a (a) of FIG. 5, the opening 121 of the metal flange 120 may have a mesh structure so that the transmission window is divided into a plurality of sections. As shown in the area (b) of FIG. 5, the opening 121 may be composed by a plurality of through-holes respectively corresponding to the transmission windows.

For example, the large-area silicon foil 140 can be used by attaching a window material support base having a pitch of 2 mm in the opening 121 in a mesh shape. Since the structure has no problem for a static elimination application or the like, the area of the silicon foil (the area of an X-ray transmission window) can be increased.

Figure 6:
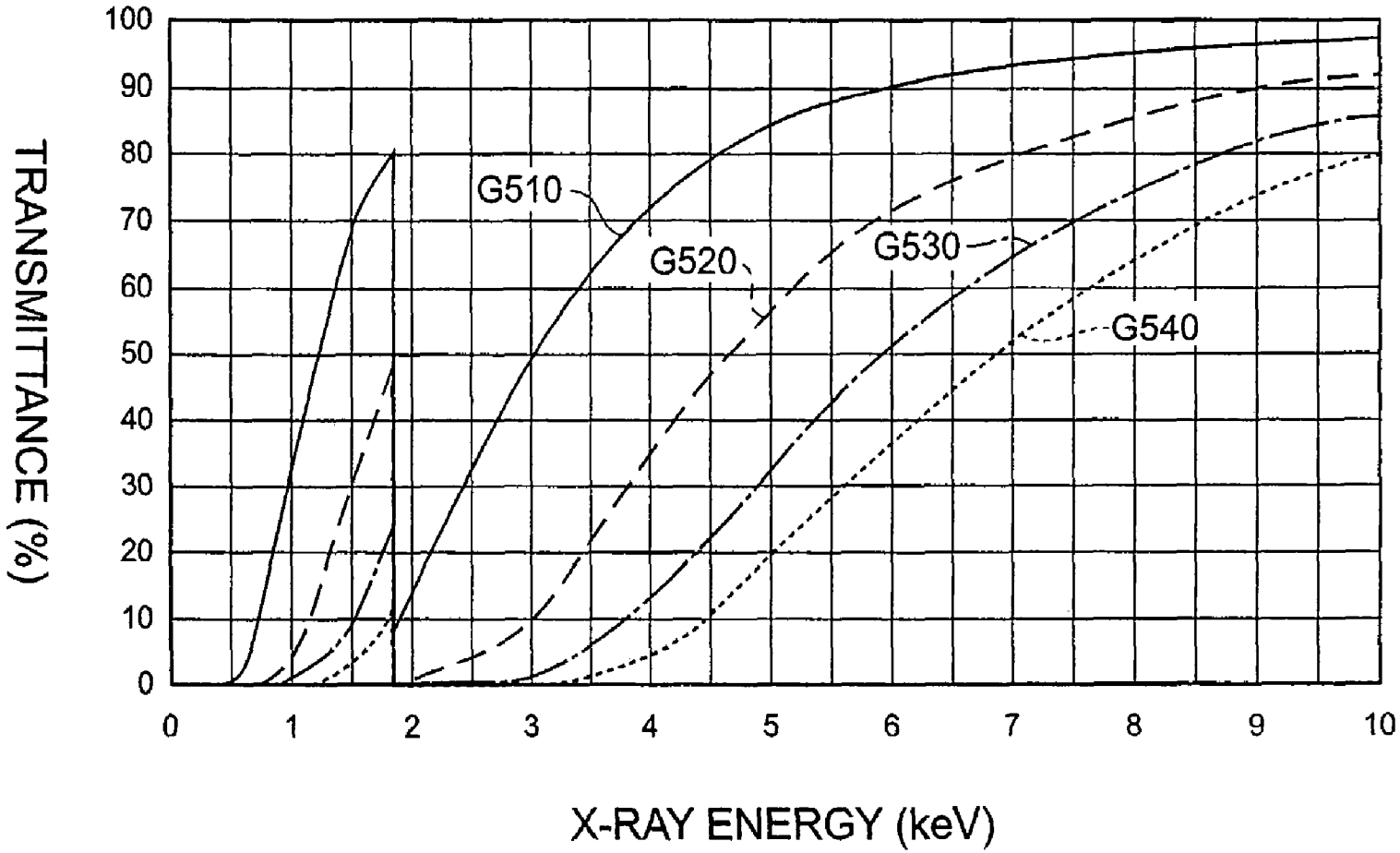
FIG. 6 is a graph showing X-ray transmissivities of various silicon foils having different thicknesses.

Next, the X-ray transmission characteristics of the silicon foils having different thicknesses are shown in FIG. 6. In FIG. 6, a graph G510, a graph G520, a graph G530 and a graph G540 show the X-ray transmittance of the silicon foil having a thickness of 3 μm, the X-ray transmittance of the silicon foil having a thickness of 10 μm, the X-ray transmittance of the silicon foil having a thickness of 20 μm, and the X-ray transmittance of the silicon foil having a thickness of 30 μm, respectively.

As shown in FIG. 6 and FIG. 1 previously described, in order to obtain the X-ray transmittance corresponding to beryllium having the thickness of 500 μm used as the conventional transmission window material, the thickness of the silicon foil is approximately 8 μm. When the thickness of the silicon foil is 3 μm or more, the silicon foil can be used as transmission window material also working as the sealing of the vacuum closed vessel, and in that case, the X-ray transmittance corresponds to beryllium having the thickness of approximately 200 μm. The X-ray transmittance of the silicon foil has a characteristic peak between 0.5 KeV and 1.8 KeV unlike in the case of beryllium. Since the X-rays of the area are very easily absorbed in air, the X-rays are immediately attenuated while generating a large quantity of negative ions. Thereby, the silicon foil has high advantages that the attainment distance of the X-rays is also short and the safety to the human body is also high. This feature does not exist in beryllium. When the X-ray tube (the X-ray tube using the silicon foil as the transmission window material) is used for the static elimination application, the effect described in the Patent Document 1 can be attained at a high efficiency.

When the silicon foil is applied to the X-ray tube having a tube voltage of tens of kilovolts or more as the transmission window material, the attenuation of the energy of X-rays due to the silicon foil is the same as that of beryllium, and the silicon foil can be applied as the transmission window material instead of beryllium without any trouble.

When this silicon foil is applied to the X-ray tube of the tube voltage of approximately 10 kV as the transmission window material in the normal soft X-ray tube for static elimination, the soft X-rays of 1.84 KeV or less which have not been conventionally emitted is outputted. Thereby, the generating amount of ions close to the X-ray tube transmission window can particularly be increased only by thus exchanging the transmission window material, and the static elimination effect can be remarkably enhanced.

In particular, the X-ray absorption end characteristics of the silicon foil itself play the role of the X-ray filter when the X-ray tube is operated by lowering the tube voltage to approximately 4 to 6 kV, the monochrome X-rays which mostly do not have a white component can easily be obtained. At this time, tungsten (M wire: approximately 1.8 keV) and aluminum (K wire: approximately 1.49 keV) or the like are suitable for the material of the X-ray target 141, and even if the silicon foil (K wire: approximately 1.74 keV) itself is operated as the X-ray target, monochrome X-rays can easily be obtained.

The material of the X-ray target 141 is not limited to the above description, and the X-ray target generating the characteristic X-rays of 1.84 KeV or less can be used. When the thickness of the silicon foil is 30 μm or less, the X-rays near 1.8 keV of 10% or more penetrate, and the silicon foil can practically be used.

Second Embodiment

Figure 7:
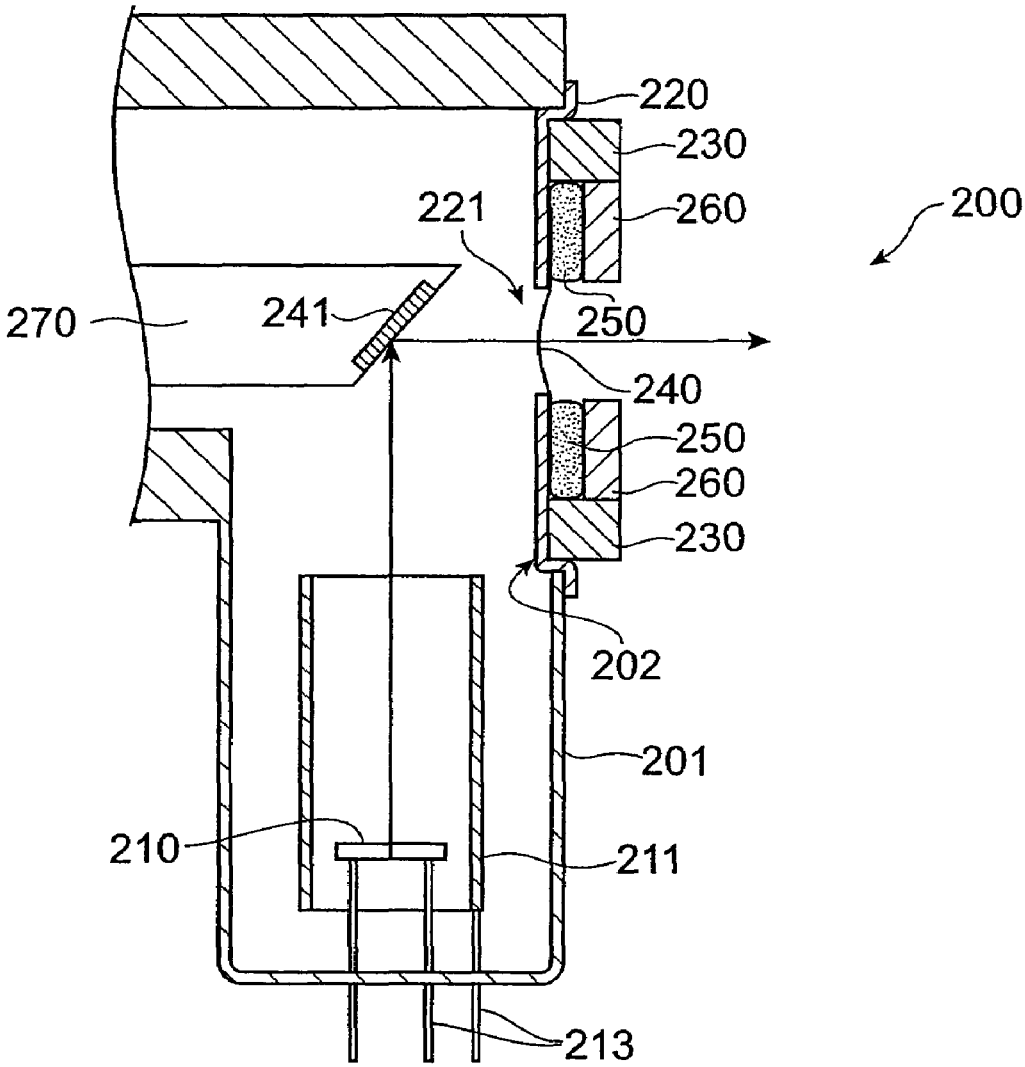
FIG. 7 is a view showing the sectional structure of a reflection type X-ray tube as a second embodiment of an X-ray tube according to the present invention.

Next, the second embodiment in the X-ray tube according to the present invention will be described. FIG. 7 is a view showing the structure of a reflection type X-ray tube 200 as the second embodiment of the X-ray tube according to the present invention.

An X-ray tube 200 according to the second embodiment is provided with a vessel body 201 provided with an opening 202. A metal flange 220 having an opening 221 for defining a transmission window is attached to the opening 202 of the vessel body 201, and the silicon foil 240 is affixed on the metal flange 220 with the silicon foil 240 directly contacted by brazing so that the opening 221 is closed. The details of the sealing of the transmission window due to the silicon foil 240 using the metal flange 220, a metal ring 230, a brazing material 250 and a press electrode 260 is the same as the sealing of the transmission window due to the silicon foil 140 using the metal flange 120, metal ring 130, brazing material 150 and press electrode 160 in the first embodiment, and the overlapping description is omitted. Since the X-ray tube according to the second embodiment is a reflection type X-ray tube, the X-ray target 241 is fixed to an X-ray target support 270. The second embodiment may have the same structure as that of FIG. 4 in the first embodiment in bonding the metal flange 220 and the vessel body 201.

An electron source 210 and a focusing electrode 211 held at a prescribed position via stem pins 213 are provided in the vessel body 201.

Meanwhile, similar to the first embodiment, when the X-ray target 141 is deposited on the silicon foil 140 as the transmission window material, the heat generation of the X-ray target may cause a problem. This is because the degradation of a target life can be expected since the thermal conductivity of silicon is decreased to some degree as compared with berylium which has been conventionally used. However, since the X-ray target 241 fixed to the X-ray target support 270 does not contact with the silicon foil 240 in the case of the reflection type X-ray tube 200 according to the second embodiment, the application of the silicon foil as the transmission window material does not affect the target life.

As described above, in the X-ray tubes 100 and 200 according to the first and second embodiments, the silicon foil as the transmission window material is affixed on the closed vessel with the silicon foil directly contacted with a part of the closed vessel. Thus, the silicon foil is directly affixed on the closed vessel so as to generate greater uniform tension on the entire silicon foil. That is, it is because distortion may be generated on a very thin silicon foil or a crack may be generated by the unevenness or the like of the surface of the brazing material when the brazing material or the like is interposed between the closed vessel and the silicon foil.

Hereinafter, the brazing of the metal flange and silicon foil applied to the first and second embodiments will be described.

(Brazing)

Figure 8:
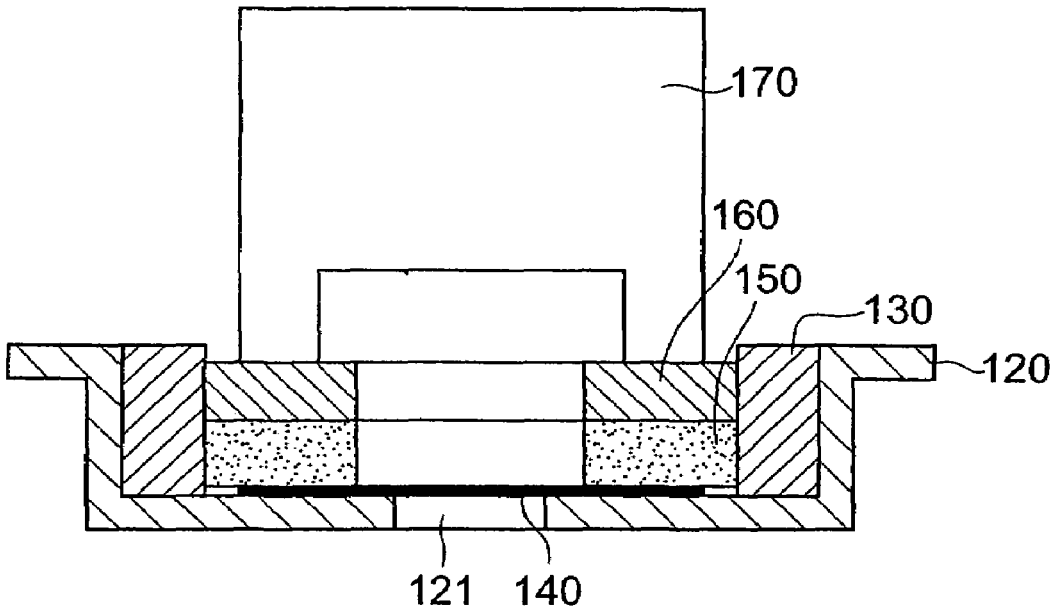
FIG. 8 is a view for explaining a method of directly adhering (brazing) the silicon foil on a part of a closed vessel.

First, FIG. 8 is a view for explaining a brazing for affixing a silicon foil on a metal material. A brazing for affixing a silicon foil 140 having a thickness of 10 μm on the metal flange 120 having an opening 121 of 2 mmϕ will be described in the first embodiment shown in FIG. 2 as a specific structure.

As the brazing material 150, part number-TB-629 (chemical component: Ag 61.5, Cu 24, In 14.5, fusion temperature of 620 to 710° C., plate thickness of 0.1 mm) was prepared, and as the metal flange 120 and the press electrode 160, stainless steel SUS304 (plate thickness of 0.1 mm) was prepared.

First, each material is cut into a predetermined size. As a limitation of the size in this case, the silicon foil 140 must be larger than the opening 121 of the metal flange 120, and must be smaller than the outer edge of the metal flange 120. The opening 151 of the brazing material 150 must be smaller than the silicon foil 140, and at the same time, the outer edge (edge part defining the size) of the brazing material 150 must have a size that at least a part of the brazing material 150 reaches to the portion of the metal flange 120 which surrounds the peripheral part of the silicon foil 140 (periphery portion containing the edge) and enables sealing by the silicon foil 140 when the brazing material 150 is melted. Therefore, it is preferable that the outer edge of the brazing material 150 is larger than the outer edge of the silicon foil 140. The outer diameter of the brazing material 150 may be the same as that of the press electrode 160. The opening 121 of the metal flange 120 is 2 mmϕ as the specific size. The thickness of the silicon foil 140 is 10 μm, and the shape is 6 mm square. The brazing material 150 and the press electrode 160 have a ring shape having an outer diameter of 13 mmϕ and an inner diameter of 4 mmϕ, respectively. In this case, if the shape of the silicon foil 140 satisfies the condition (larger than the opening 121 in the metal flange 120 and smaller than the outer edge of the metal flange 120), the shape may be arbitrary.

Next, when a burr at the time of opening 121 is formed at the corner of the opening 121 of the metal flange 120, it is necessary to remove the burr completely by various mechanical polishing or electrolytic polishing processing. Particularly, it is preferable that the corner is subjected to a curved surface processing to remove the edge at the corner of the opening 121 of the side of the silicon foil 140 provided, since the silicon foil 140 is hardly damaged. Then, the metal flange 120 and the press electrode 160 is heated at 880° C. in a vacuum to remove the gas and distortion. Then, it is preferable that copper having a thickness of, for example, 200 nm is deposited on to a part (the metal flange 120, the silicon foil 140 and the press electrode 160) to which the brazing material 150 is contacted. Thereby, the brazing material 150 fits in each material well. The same effect is obtained when not only copper but also nickel or the titanium is thinly deposited.

Then, these members are set on a work table. The metal flange 120, the silicon foil 140, the brazing material 150 and the press electrode 160 are set in this order from the bottom. Further, a jig 170 (material: SUS304, an outer diameter of 12 mm×an inner diameter of 6 mm×height of 20 mm) for preventing a displacement at the time of heating is set on the press electrode 160 (FIG. 8). Under the present circumstances, it is necessary to take care so that the center gap (gap from the axis AX in FIG. 2) does not occur. Even if the press electrode 160 and the metal flange 120 are lightly spot-welded in a circumference part via the brazing material 150 so as to sandwich the silicon foil 140 and the brazing material 150 where needed, no problem occurs in the subsequent brazing. Or, the metal ring 130 (material: SUS304) for center alignment may be set so as to surround the press electrode 160 and the brazing material 150.

A heat-treatment for melting the brazing material 150 in a vacuum heating furnace is then performed. The brazing conditions are the following items (1) to (4): (1) heating from room temperature up to 680° C. for 90 minutes; (2) maintaining the temperature for 5 minutes; (3) cooling to 560° C. in 2 minutes by stopping the heating; and (4) taking out the metal flange 120 from the electric furnace and cooling to 300° C. for 2 hours. Then, a rapid cooling is performed by vacuum-leaking the inside of the vacuum heating furnace by dry nitrogen, and the metal flange 120 is cooled to around room temperature and taken out. Finally, a vacuum leak is checked by a helium leak detector, no leak is checked, and work is ended.

Third Embodiment

Figure 9:
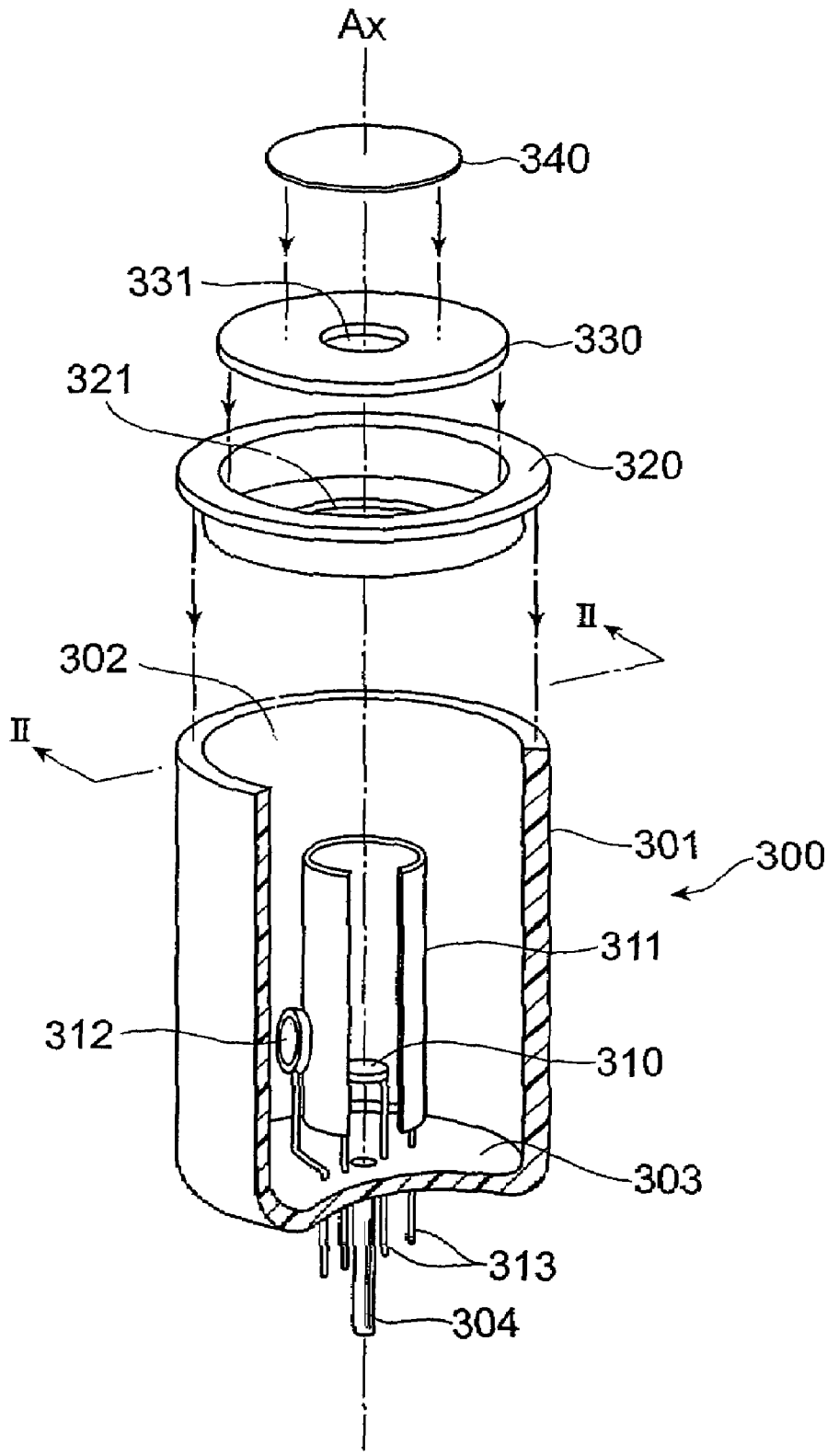
FIG. 9 is an assembly process chart showing the structure of a transmission type X-ray tube as the third embodiment of the X-ray tube according to the present invention.
Figure 10:
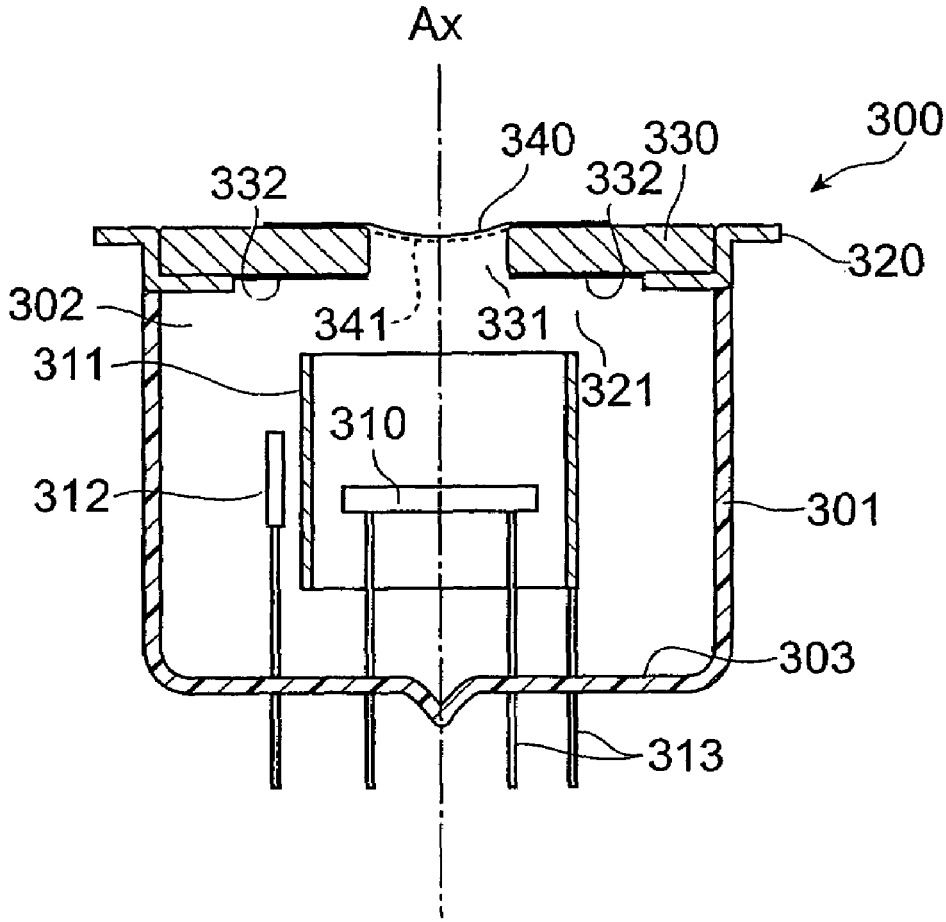
FIG. 10 are views showing the sectional structure of an X-ray tube according to a third embodiment along the line II-II in FIG. 9.
Figure 10:
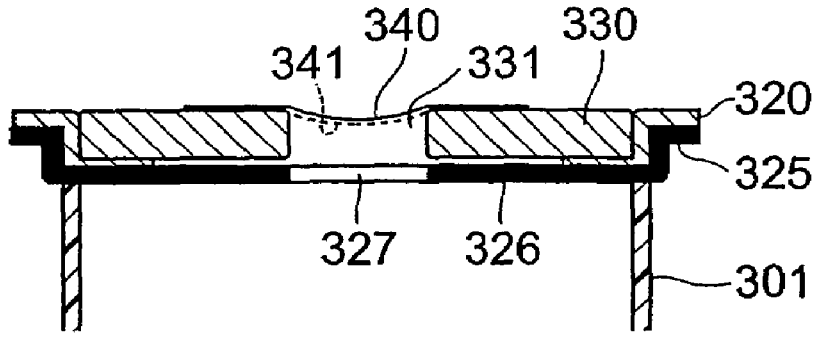

Then, the third embodiment in the X-ray tube according to the present invention will be described. FIG. 9 is an assembly process chart showing the structure of a transmission type X-ray tube as the third embodiment of the X-ray tube according to the present invention. The area (a) of FIG. 10 shows a view showing the sectional structure of an X-ray tube 300 according to the third embodiment along the line II-II in FIG. 9.

An X-ray tube 300 according to the third embodiment is provided with a vessel body (glass vessel) 301 having an opening 302 and a metal flange 320 attached to the opening 302. An opening 321 is formed at the center of a hollow of the metal flange 320, and a glass faceplate 330 containing alkaline ions is inserted into the hollow of the metal flange 320. An opening 331 for defining a transmission window is formed in the glass faceplate 330, and the silicon foil 340 covers the opening 331 and is directly affixed on the glass faceplate 330. The metal flange 320, the glass faceplate 330 and the silicon foil 340 are affixed to the opening 302 of the vessel body 301 in order along the central axis AX of the vessel body 301.

Particularly, in the third embodiment, the silicon foil 340 is affixed on the alkali-containing glass faceplate 330 with the silicon foil 340 directly contacted with the glass faceplate 330 by anodic bonding so that the opening 331 is closed, and the vacuum closed vessel is constituted by the vessel body 301, the metal flange 320, the glass faceplate 330 and the silicon foil 340.

There is provided a vacuum pipe 304 for vacuuming as the vacuum closed vessel by vacuuming the closed vessel constituted by the vessel body 301, the metal flange 320, the glass faceplate 330 and the silicon foil 340 in the vessel body 301, and an electron source 310, a focusing electrode 311 and a gas adsorption material 312 are arranged in the vessel body 301. Stem pins 313 penetrating a bottom part 303 for applying a predetermined voltage to the members and holding the members at a prescribed position in the vessel body 301 are arranged on a bottom part 303 of the vessel body 301. The protection electrode 332 such as, aluminum and chromium is deposited on the surface of the side of the vacuum closed vessel of the glass faceplate 330 located around the opening 331 so as to contact with the metal flange 320 for prevention of unstable operation due to electrification in the vacuum closed vessel caused by an electron beam hitting the surface of the side of the vacuum closed vessel directly. Therefore, the protection electrode 332 has the same potential as that of the metal flange 320. Although the protection electrode 332 is easily formed by the vapor deposition, since thickness may be thin and the electrical connection may become poor in vapor deposition, the protection electrode 332 is preferably a metal plate such as stainless steel so as to reliably have the same potential as metal flange 320. Since the metal flange itself functions as the protection electrode in the first embodiment which has no glass faceplate and in which a part of the closed vessel is composed by a metal flange, the protection electrode in the third embodiment is unnecessary.

Although the third embodiment may have the same structure as FIG. 4 in the first embodiment in the bonding of the metal flange 320 and vessel body 301, the third embodiment may be particularly provided with the structure shown in the area (b) of FIG. 10 as a structure requiring no protection electrode. Although the structure shown in the area (b) is different from the structure shown in the (a) in that another metal flange 325 is provided between the metal flange 320 and the vessel body 301, the other structures are the same as that shoen in the area (a). That is, in the third embodiment, as shown in the area (a) of FIG. 10, another metal flange 325 is also provided on the opening 302 of the vessel body 301, and a projection end 326 in the vessel for defining the opening 327 of the metal flange 325 covers the surface of the side of the vacuum closed vessel of the glass faceplate 330 located around the opening 331. Thereby, the same effect is obtained without providing the protection electrode 332 in FIG. 10(*a*).

An X-ray target 341 is deposited on the surface of the side facing inside the vacuum closed vessel of the silicon foil 340 affixed on the glass faceplate 830, and more particularly the surface of the side facing the vacuum vessel of the portion of the silicon foil 340 substantially covers the opening 331. The potentials of the metal flange 320, the protection electrode 332, the silicon foil 340 and the target 341 become identical by electrically connecting a part of the deposited X-ray target 341 with the protection electrode 332. However, since deposition on the corner of the opening 331 of the side located in the vacuum closed vessel may not be well performed, the metal flange 320 or the protection electrode 332, and the silicon foil 340 or the X-ray target 341 may be electrically connected via the conductive member. It is particularly preferable in the structure shown in the area (b) of FIG. 10. For example, either of the metal flange 320, the protection electrode 332 and the silicon foil 340 may be grounded via the conductive member when the side of the X-ray target 341 is set to GND potential and used in the X-ray tube according to the third embodiment. When the X-ray target 341 and the protection electrode 332 consist of a common material, both the X-ray target 341 and the protection electrode 332 can also be formed together by vapor deposition. Not only a hot cathode electron source such as a conventional filament, but also a cold cathode electron source such as a carbon nanotube electron source when the X-ray tube itself is miniaturized can also be applied to the electron source 310.

Figure 11:
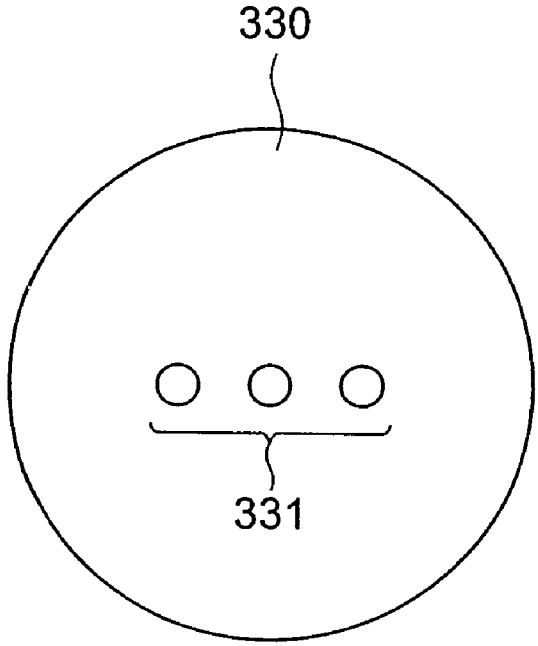
FIG. 11 are plan views showing other structures of an opening of a glass faceplate for defining a transmission window.
Figure 11:
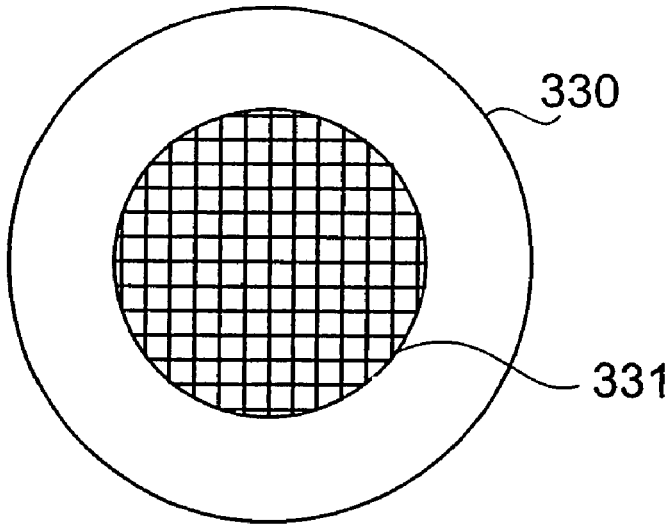

The silicon foil 340 applied to the transmission type X-ray tube 300 according to the third embodiment has a thickness of 30 μm or less, preferably of 10 μm or less. Thus, since the thickness of the silicon foil 340 is very thin, crack may be generated when the area of the opening provided on the glass faceplate 330 is too large. Specifically, when the transmission window having a diameter of 10 mm or more and a large area is airtightly sealed by one silicon foil, the silicon foil is bent by a pressure differential between the inside and outside of the closed vessel, and crack may be generated. This is based on the silicon foil itself lacking strength. Then, as shown in FIG. 11, it is preferable that the opening 331 of the glass faceplate 330 has a structure which the transmission window is previously divided into a plurality of sections. In the area (a) shown in FIG. 11, as the opening 331, a plurality of through-holes respectively corresponding to the transmission window are formed in the glass faceplate 330. As shown in the area (b) of FIG. 11, the opening 331 may have a mesh structure so that the transmission window is divided into a plurality of sections.

For example, when a plurality of through-holes having a diameter of 5 mm or less are provided as the opening 331, the silicon foil 340 of large area having a diameter of 10 mm or more can be used. Since the structure has no problem for a static elimination application or the like, the area of the silicon foil can be increased. Since the silicon foil is firmly bonded by using an anodic bonding technique, a firm vacuum seal can be attained.

When the anodic bonding is performed, the size of the glass faceplate 330 to which the silicon foil 340 is affixed becomes a problem. Particularly, in the structure which the glass faceplate 330 is attached on the metal flange 320 of the vessel body 301, the peripheral part of the glass faceplate 330 is raised by heating at the time of attaching the glass faceplate 330. When the maximum outer diameter of the silicon foil 340 is close to the minimum outer diameter of the glass faceplate 330 at this time, the silicon foil 340 tends to be affixed so that the silicon foil is bridged over the flat part of the glass faceplate 330 and the raised peripheral part, and the peripheral part tends to push up to the central area of the silicon foil 340. Therefore, a crack or uneven bonding may be generated. That is, as shown in the area (a) of FIG. 12, when the silicon foil 340 is affixed on the raised glass faceplate 330 of the peripheral part, the circumference part of the silicon foil 340 is locally bent by the raised part A of the glass faceplate 330, and the risk that the silicon foil 340 itself may be damaged at the time of anodic bonding increases.

Therefore, it is preferable that the outer edge of the glass faceplate 330 is sufficiently larger than the outer edge of the silicon foil 340. Specifically, as shown in the area (b) of FIG. 12, the glass faceplate 330, of which the minimum outer diameter D1 is sufficiently larger than the maximum outer diameter D2 of the silicon foil 340 affixed is prepared. In this case, since the attaching area of the silicon foil 340 can be fully secured on the glass faceplate 330, the shape of the silicon foil 340 is not particularly limited to a round shape, and may be a polygon and a shape containing curves.

Figure 12:
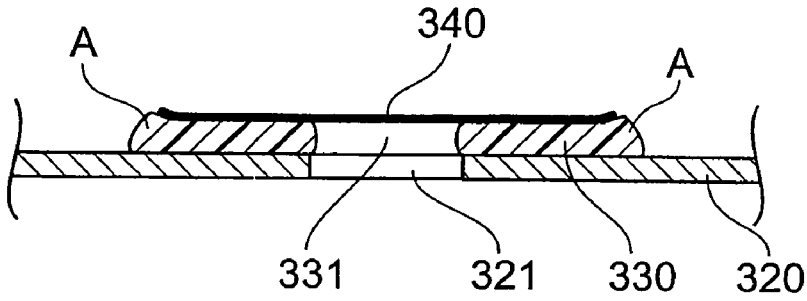
FIG. 12 are views showing structures of the glass faceplate (first)
Figure 12:
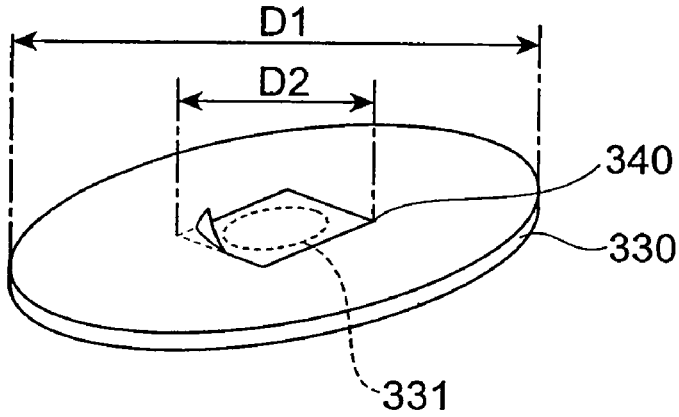
Figure 12:
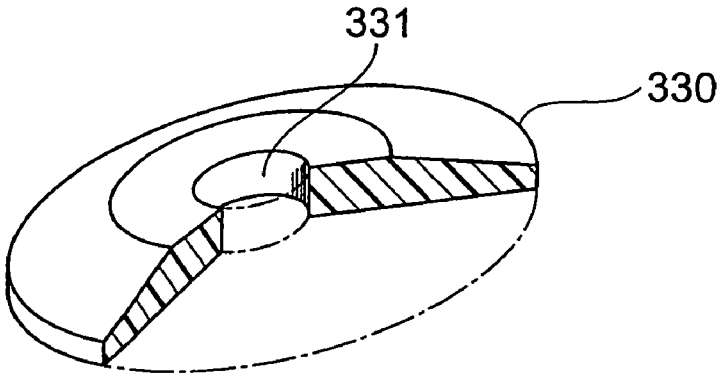

However, even when the maximum outer diameter D2 of the silicon foil 340 is close to the minimum outer diameter D1 of the glass faceplate 330, for example, as shown in the area (a) of FIG. 12, the glass faceplate 330 may be processed so that the thickness of the section is reduced in a taper shape from the flat part around the part having the opening toward the peripheral part. In this case, even if glass faceplate 330 is heated to be attached, the raising of the peripheral part is avoided, and the generation of a crack and uneven bonding of the silicon foil 340 directly affixed on the glass faceplate 330 are eliminated.

Figure 13:
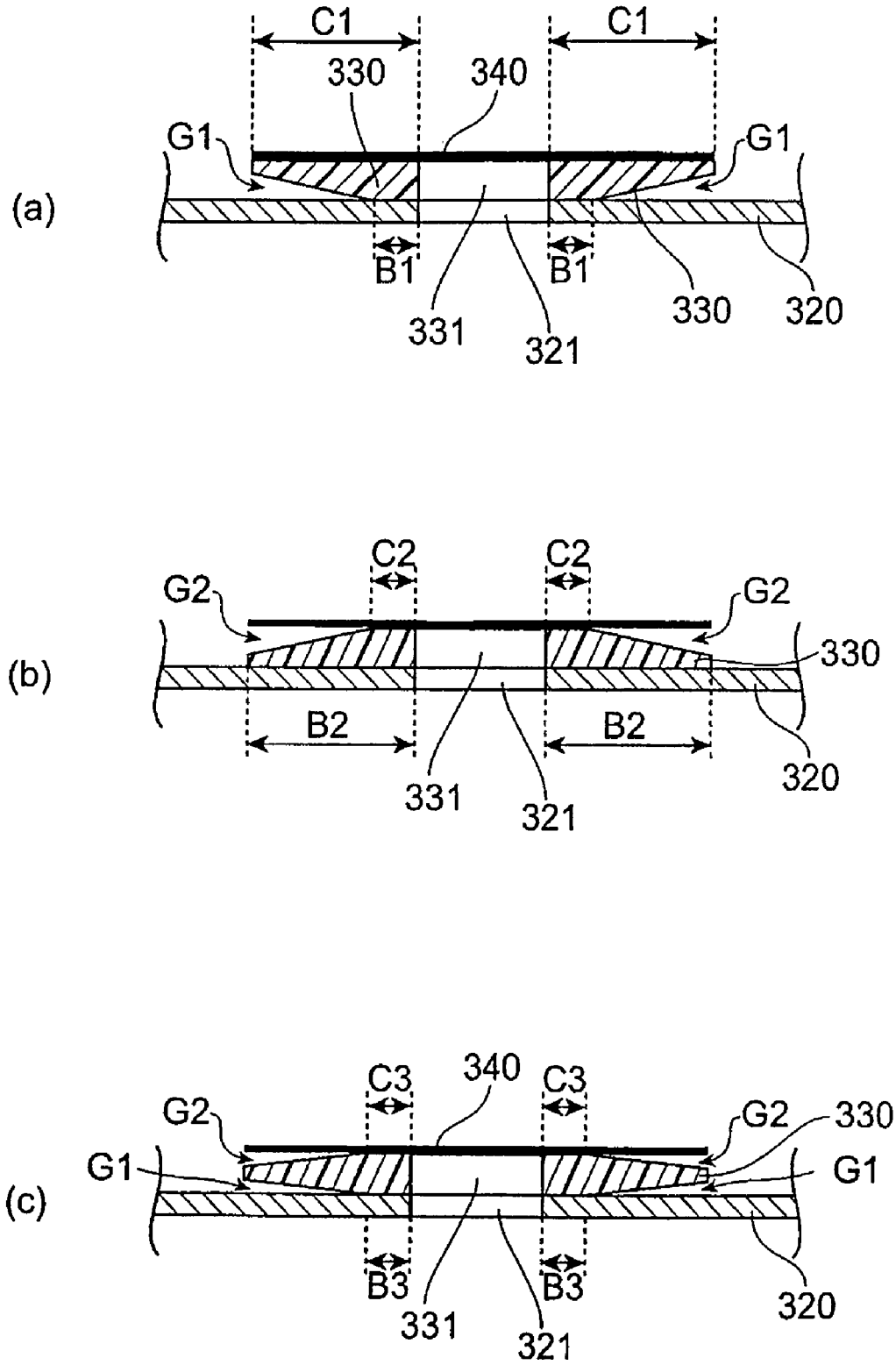
FIG. 13 are views showing structures of the glass faceplate (second)

In particular, as shown in the area (a) of FIG. 13, the glass faceplate 330 having the shape where a gap G1 is formed between the metal flange 320 and the glass faceplate 330 can be applied. As shown in the area (a) of FIG. 13, only one surface of the glass faceplate 330 is obliquely cut toward the peripheral part by the structure, the glass faceplate 330 is attached on the metal flange 320 in an area B1. On the other hand, the silicon foil 340 is affixed on the glass faceplate 330 in an area C1. As shown in the area (b) of FIG. 13, the glass faceplate 330 having a shape where a gap G2 is formed between the silicon foil 340 and the glass faceplate 330 can also be applied. Even in the area (b) shown in FIG. 13, only one surface of the glass faceplate 330 is obliquely cut toward the peripheral part. In the structure, the silicon foil 340 contacts with only an area C2 around the opening 331 of the glass faceplate 330, and the peripheral part of the silicon foil 340 is spaced via a gap G2 from the glass faceplate 330. On the other hand, the glass faceplate 330 and the metal flange 320 are closely contacted in an area B2 as a whole. As shown in the area (c) of FIG. 13, a gap G1 is formed between the metal flange 320 and the glass faceplate 330, and the glass faceplate 330 having a shape where a gap G2 was formed between the silicon foil 340 and the glass faceplate 330 can also be applied. In the area (c) of FIG. 13, both surfaces of the glass faceplate 340 are obliquely cut toward the peripheral part by the structure, the glass faceplate 330 is attached on the metal flange 320 in an area B3. On the other hand, the silicon foil 340 is affixed on the glass faceplate 330 in an area C3.

Fourth Embodiment

Figure 14:
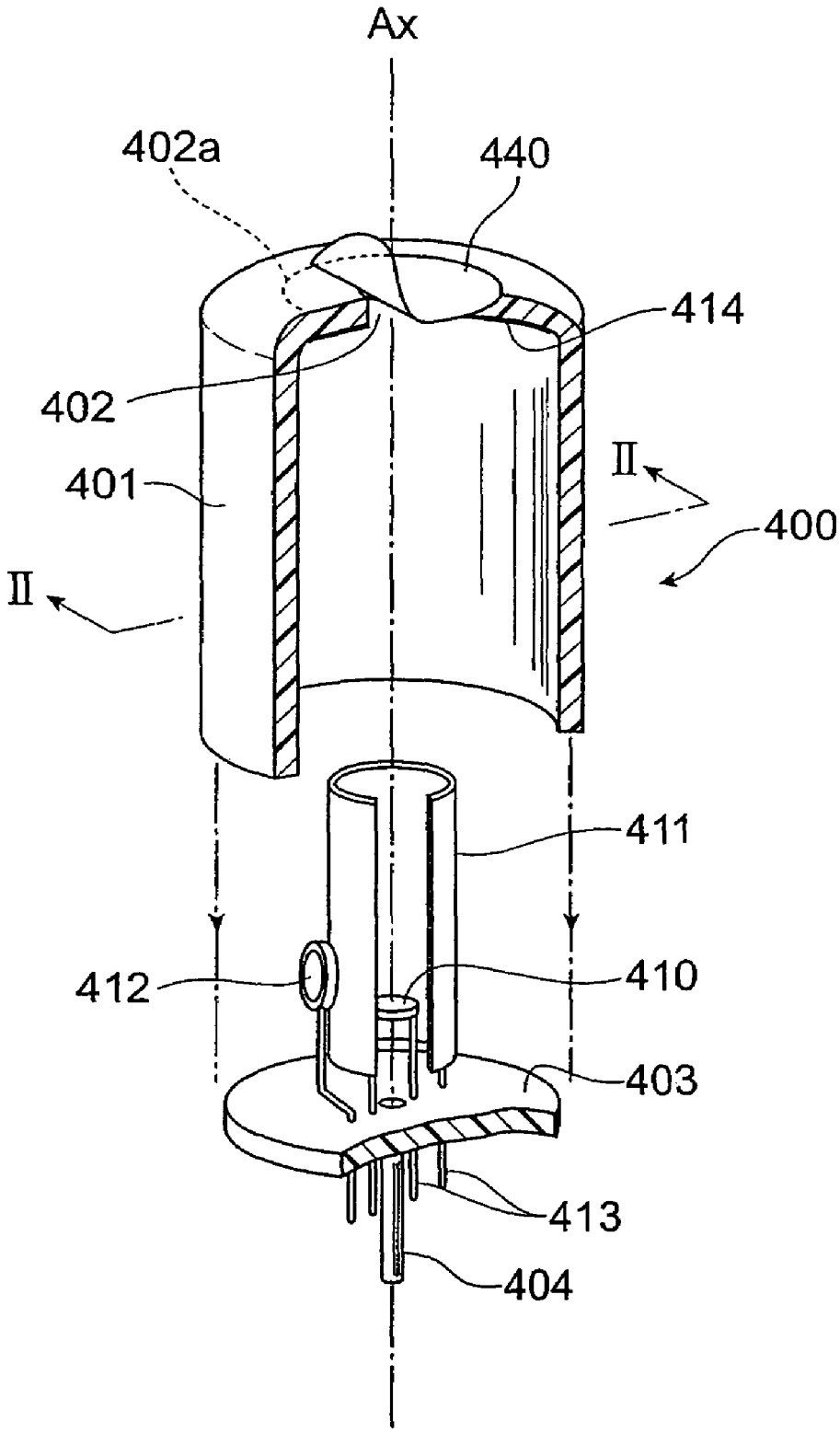
FIG. 14 is an assembly process chart showing the structure of a transmission type X-ray tube as a fourth embodiment of an X-ray tube according to the present invention.
Figure 15:
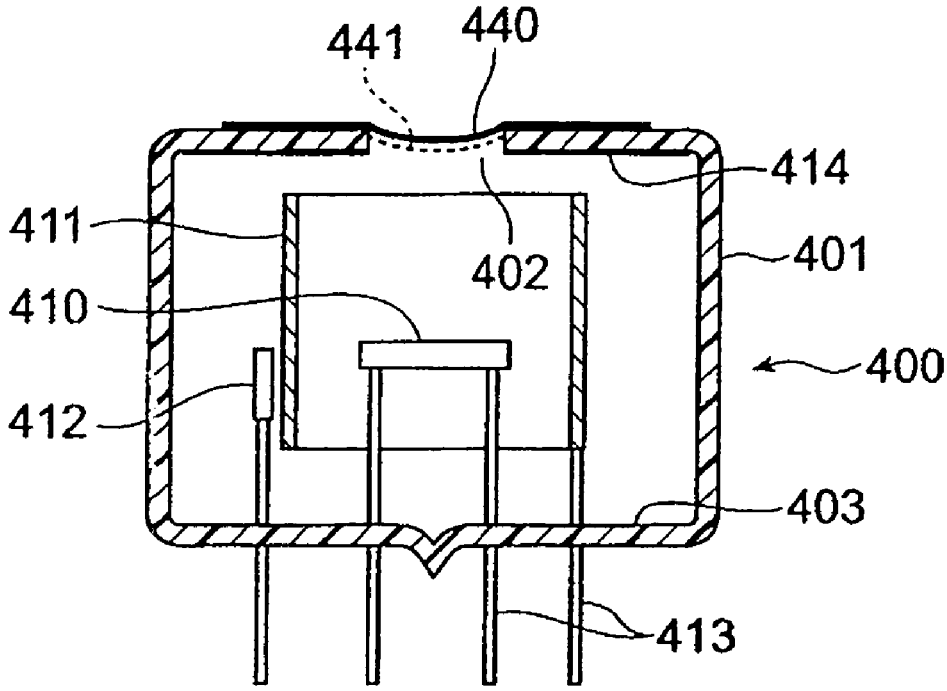
FIG. 15 is a view showing the sectional structure of an X-ray tube according to a fourth embodiment along the line III-III in FIG. 14.

Next, the fourth embodiment in the X-ray tube according to the present invention will be described. FIG. 14 is an assembly process chart showing the structure of a transmission type X-ray tube 400 as a fourth embodiment of an X-ray tube according to the present invention. FIG. 15 is a view showing the sectional structure of an X-ray tube 400 according to a fourth embodiment along the line III-III in FIG. 14.

In the X-ray tube 400 according to the fourth embodiment, the closed vessel is constituted by a vessel body (alkali-containing glass vessel) 401 containing a glass faceplate as a flat part in which an opening 402 for defining the transmission window is formed, a silicon foil 440 affixed on an area 402*a* on the glass faceplate so that the opening 402 is closed, and a glass stem 403 is attached on the vessel body 401 along the axis AX. The silicon foil 440 is affixed on the area 402*a* on the alkali-containing glass faceplate as a part of the vessel body 401 with the silicon foil 440 directly contacted with the area 402*a* by anodic bonding. A vacuum pipe 404 for vacuuming the closed vessel constituted by the vessel body 401, the silicon foil 440 and the glass stem 403 to form the vacuum closed vessel is provided in the glass stem 403, and an electron source 410, a focusing electrode 411 and a gas adsorption material 412 are attached via a stem pin 413 so as to be stored in the vessel body 401. A protection electrode 414 consisting of a metal plate, for example, such as stainless steel for preventing instability of operation due to electrification in the vacuum closed vessel caused by a direct hit to the surface on the side of the vacuum closed vessel of an electron beam is set on the surface of the side of the vacuum closed vessel of the glass faceplate of the vessel body 401 located around the opening 402. The potential of the protection electrode 414 is the same as that of the silicon foil 440 as the transmission window.

Even in the fourth embodiment, an X-ray target 441 is deposited on the surface of the side facing inside the vacuum closed vessel of the silicon foil 440 directly contacted and affixed on the the glass faceplate of the vessel body 401, and more particularly the surface of the side facing the vacuum vessel of the portion of the silicon foil 440 substantially covering the opening 402. The potentials of the protection electrode 414, silicon foil 440 and X-ray target 441 become identical by electrically connecting a part of the deposited X-ray target 441 with the protection electrode 414. However, since deposition may not be well performed on the corner of the opening 402 of the side located in the vacuum closed vessel, the protection electrode 414 may be electrically connected with the silicon foil 440 or the X-ray target 441 via the conductive member. For example, the protection electrode 414 or the silicon foil 440 may be grounded via the conductive member when setting and using the side of the X-ray target 441 to GND potential in the X-ray tube according to the fourth embodiment. When the X-ray target 441 and the protection electrode 414 consist of a common material, both the X-ray target 441 and the protection electrode 414 can also be formed together by vapor deposition. Not only a hot cathode electron source such as a conventional filament, but also a cold cathode electron source such as a carbon nanotube electron source can also be applied to the electron source 410 when the X-ray tube itself is miniaturized.

The silicon foil 440 applied to the transmission type X-ray tube 200 according to the fourth embodiment has a thickness of 30 μm or less, preferably of 10 μm or less. Thus, since the silicon foil 440 is very small in thickness, a crack may be generated when the area of the opening (corresponding to the opening 402 of the glass faceplate constituting a part of the vessel body 401 in the fourth embodiment) provided on the closed vessel is too large. Then, even in the fourth embodiment, as shown, for example, in FIG. 11, the glass faceplate of the vessel body 401 may have a plurality of through-holes respectively corresponding to the transmission window. The glass faceplate may be provided with a mesh structure so that the transmission window is divided into a plurality of sections. Particularly, the anodic bonding can be applied when a substrate for fixing the silicon foil is glass containing alkali. However, since the silicon foil 440 itself is firmly bonded to the mesh-like support base when the silicon foil 440 is anode-bonded on the glass faceplate having the mesh structured transmission window, a stronger vacuum seal can be attained.

As described above, the closed vessel and the silicon foil 440 is attached by anodic bonding even in the fourth embodiment. In this case, the X-ray tube can be manufactured by not only the case of bonding directly the silicon foil 440 previously thinned and the vessel body 401 (flat part as the glass faceplate) but also thinning is performed by chemical etching and machine polish or the like after bonding a thick silicon to the glass faceplate part. For example, since the thickness of the silicon wafer may be set to 3 to 10 μm by chemical etching or machine polish after sealing by anodic bonding using an inexpensive silicon wafer having a thickness of 200 to 400 μm, a more inexpensive X-ray tube can be manufactured and supplied. Borosilicate glass (covar glass) and Pyrex (registered trademark) glass containing a significant amount alkali are generally used for a glass member used in the case of anodic bonding.

Fifth Embodiment

Figure 16:
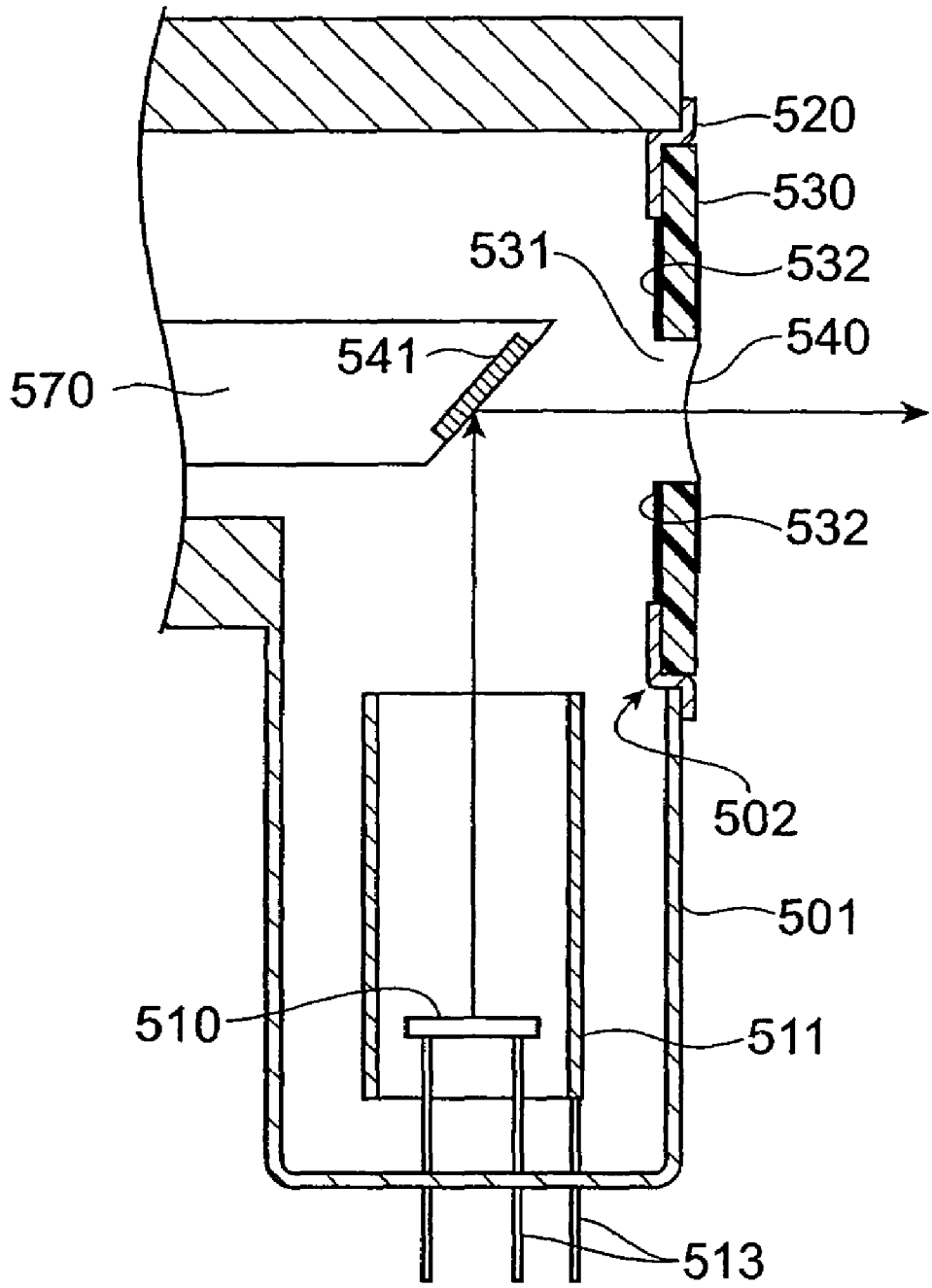
FIG. 16 is a view showing the structure of a reflection type X-ray tube as a fifth embodiment of an X-ray tube according to the present invention.

Next, the fifth embodiment in the X-ray tube according to the present invention will be described. FIG. 16 is a view showing the structure of a reflection type X-ray tube 500 as a fifth embodiment of an X-ray tube according to the present invention.

An X-ray tube 500 according to the fifth embodiment is provided with a vessel body 501 provided with an opening 502. A glass faceplate 530 on which an opening 531 for defining a transmission window is provided is bonded to the metal flange 520 by, for example, fusion, and the metal flange 520 is attached to the opening 502 of the vessel body 501. The silicon foil 540 is affixed on the glass faceplate 530 with the silicon foil 540 directly contacted by anodic bonding so that the opening 531 is closed. Since the X-ray tube according to the fifth embodiment is a reflection type X-ray tube, the X-ray target 541 is fixed to an X-ray target support 570. A protection electrode 532 is installed on a surface facing inside the vessel of the glass faceplate 530. The fifth embodiment may have the same structure as that of FIG. 4 in the first embodiment in bonding the metal flange 520 and the vessel body 501.

An electron source 510 and a focusing electrode 511 held at a prescribed position through stem pins 513 are provided in the vessel body 501.

Meanwhile, as the third and fourth embodiments described above, when the X-ray targets 341 and 441 are deposited on the silicon foils 340 and 440 as the transmission window material, the heat generation of the X-ray target may cause a problem. This is because the degradation of a target life can be expected since the thermal conductivity of silicon is decreased to some degree as compared with berylium which has been conventionally used. However, since the X-ray target 541 is fixed to the X-ray target support 570 and is in a non-contact manner with the silicon foil 540 in the case of the reflection type X-ray tube 500 according to the second embodiment, the application of the silicon foil as the transmission window material does not affect the target life.

As described above, in the X-ray tubes 300 to 600 according to the third to fifth embodiments, the silicon foil as the transmission window material is affixed on the glass faceplate constituting a part of the closed vessel with the silicon foil directly contacted with the glass faceplate. The silicon foil is thus directly affixed on the closed vessel so as to generate greater uniform tension on the entire silicon foil. That is, it is because distortion may be generated on a very thin silicon foil or a crack may be generated by the unevenness or the like of the surface of the brazing material when the brazing material or the like is interposed between the closed vessel and the silicon foil.

Hereinafter, the anodic bonding of the silicon foil and glass faceplate (alkali-containing glass) applied to the third to fifth embodiments will be described.

(Anodic Bonding)

Figure 17:
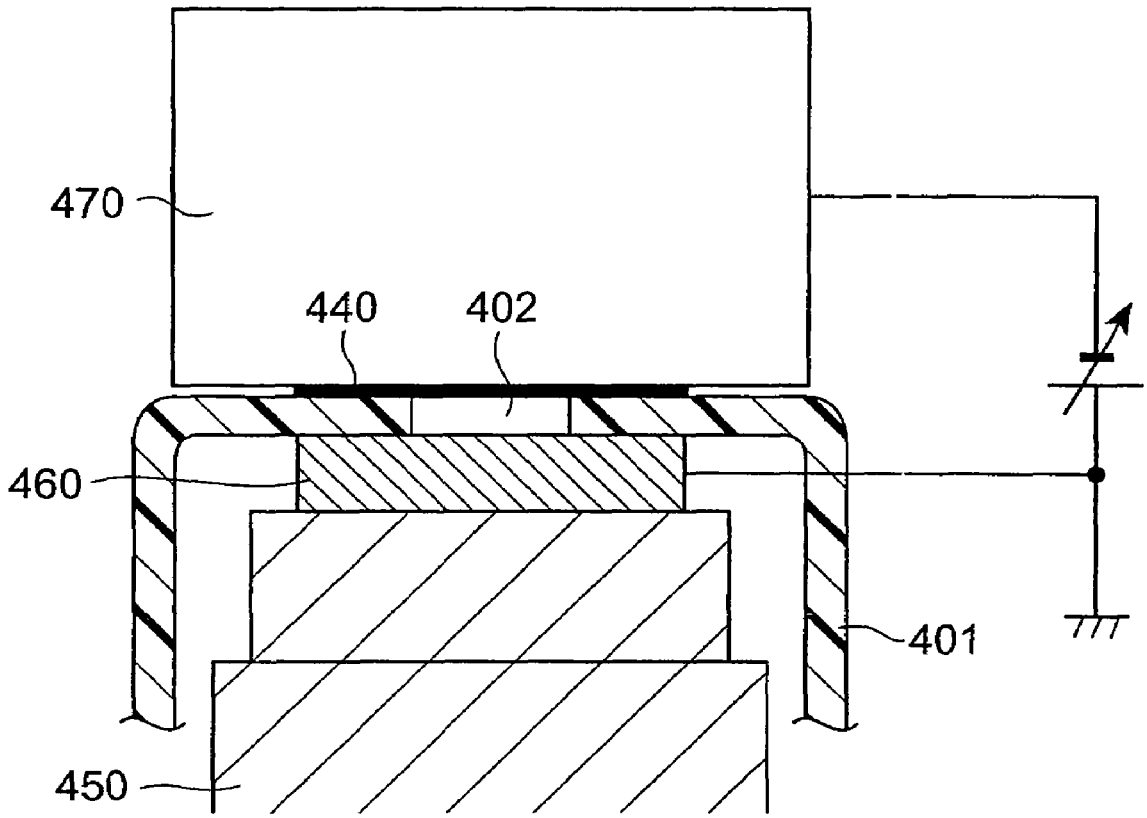
FIG. 17 is a view for explaining a method (anodic bonding) of adhering the silicon foil on a part (a glass plate containing an alkaline ion) of the closed vessel.

FIG. 17 describes an anodic bonding for affixing the silicon foil on an alkali-containing glass. As a specific structure, in the fourth embodiment shown in FIG. 14, the anodic bonding for affixing a silicon foil 440 having a thickness of 10 μm on a glass vessel body 401 having an opening 402 of 3 mmϕ is described.

Although the thickness of the silicon foil 440 is required for the thickness of the range where the closed vessel can be vacuum-sealed so as to apply vacuum airtightness to the closed vessel, the thickness of the silicon foil 440 is advantageously as thin as possible in view of X-ray transmittance. Although the silicon foil 440 having the thickness of approximately 3 μm or more can be used as the transmission window material also working as the seal of the vacuum closed vessel, in the example, the silicon foil 440 having the thickness of 10 μm was prepared for giving priority to easy handling. In the example, the thickness of the silicon foil 440 was set to 10 μm by machine polish. Even when this is the silicon foil produced by etching, it has no trouble when being used.

The glass used for the anodic bonding must contain alkaline ions. This is because the anodic bonding is a method of moving the alkaline ions in the glass and bonding them by applying a voltage while heating the glass. It is preferable to have a thermal expansion coefficient close to that of the silicon as the condition required for the glass. When the thermal expansion coefficient is widely different, even if the bonding can be performed, the silicon foil is broken when cooled after the bonding. There are Pyrex glass and borosilicate glass as the glass satisfying the conditions. In the example, the borosilicate glass is used in view of the availability, the ease of the incorporation to the electron tube after the bonding and the ease of processing. The thickness of the borosilicate glass was set to 1 mm so as to maintain vacuum airtightness as a vacuum tube.

First, a hole 402 having a diameter of 3 mm is opened in an upper central part 402*a* of a glass vessel 401 as a faceplate having the transmission window of the X-ray tube. The opening 402 can easily be opened by ultrasonic processing or the like. Burrs and cracks around the opening 402 are corrected by machine processing polish after drilling processing, and a surface treatment is performed to obtain as uniform a circle shape as possible. In that case, particularly, it is more preferable that the corner part of the silicon foil 440 side of the opening 402 is processed to a curved surface. Then, the surface of the glass vessel 401 is degreased and washed. Thereafter, the silicon foil 440 is cut into approximately 7 mm square. It is preferable that the silicon foil 440 is larger than the opening 402 in the glass vessel 401 and is smaller than the outer edge of the glass vessel 401, and the shape is not limited.

Next, a hot plate 450 capable of being heated to approximately 400° C. is prepared, and an aluminum plate 460 having a thickness of 1 mm is set as a grand potential on the hot plate 450. The glass vessel 401 having the opening 402 is placed on the aluminum plate 460, and the silicon foil 440 is set so that the opening 402 is covered. A metal weight 470 (SUS 304, a diameter of 7 mm, a height of 40 mm) is set on the silicon foil 440. A wire for applying the voltage of 500V to 1000V is attached to the weight 470.

The hot plate 450 is heated to 400° C. after setting each member as described above. As a result, the aluminum plate 460 set to the grand potential, glass vessel body 401 and silicon foil 440 on the hot plate 450 are heated to 350° C. or more. When a voltage of approximately +500V is applied to the weight 470 placed on the silicon foil 440 in the heating state, a current of several mA flows to the aluminum plate 460 from the weight 470 through the silicon foil 440 and the glass vessel body 401. Since the current is immediately attenuated, and the current becomes tens of μA or less after several minutes, the anodic bonding is ended therein. After the anodic bonding is completed, the hot plate 450 is turned OFF. Even when the silicon foil 440 is immediately quenched to room temperature, a crack or the like is not generated on the silicon foil 440. Although the heating work in the example is performed in the atmosphere, the danger of a vacuum leak is decreased since the generation of a bubble at a bonded part is suppressed when the heating work is performed in vacuum. The silicon foil 440 and the glass vessel body 401 may be bonded at the inner side of the glass vessel body 401, and the voltage applied to the weight 470 in that case is conversely set (the voltage of −500V is applied).

Lastly, a vacuum leak is checked by the helium leak detector, and no leak is checked. The X-ray target 441 is deposited on the inner surface of the silicon foil 440, and the silicon foil 440 is combined with the electron source 410, the focusing electrode 411 and the protection electrode 414, and they are incorporated in the X-ray tube. Thereby, the X-ray tube using the silicon foil as the transmission window material is obtained.

Since the anodic bonding described above solves the problem caused by the brazing, and the number of processes can be largely reduced as compared with the brazing, the manufacturing cost of the X-ray tube can be further reduced.

Figure 18:
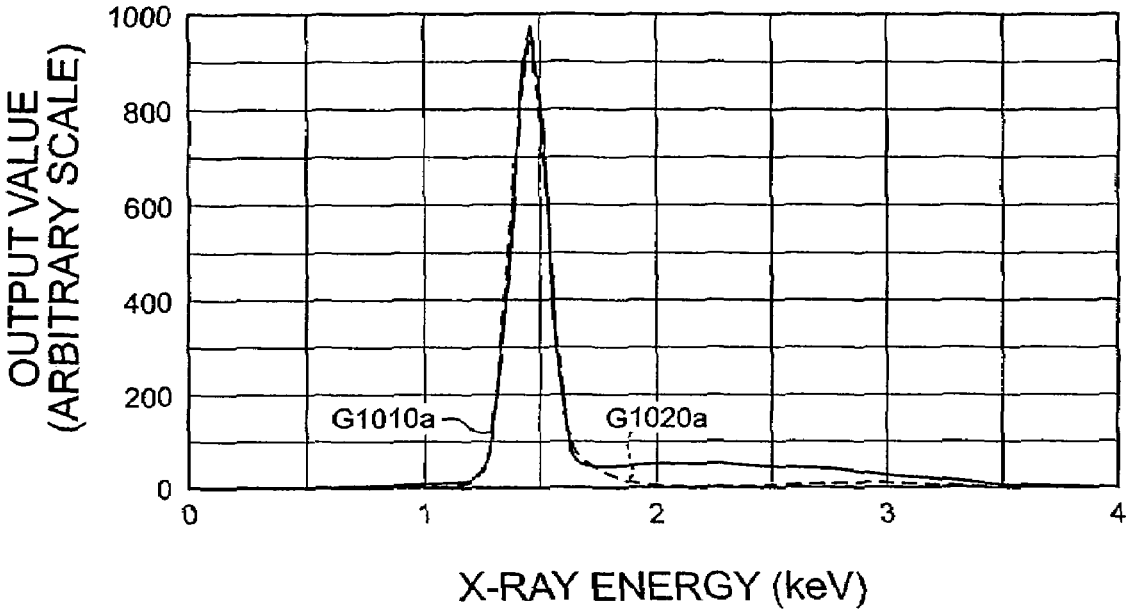
FIG. 18 are X-ray spectrums obtained by the X-ray tube to which beryllium and silicon are applied as a transmission window material.
Figure 18:
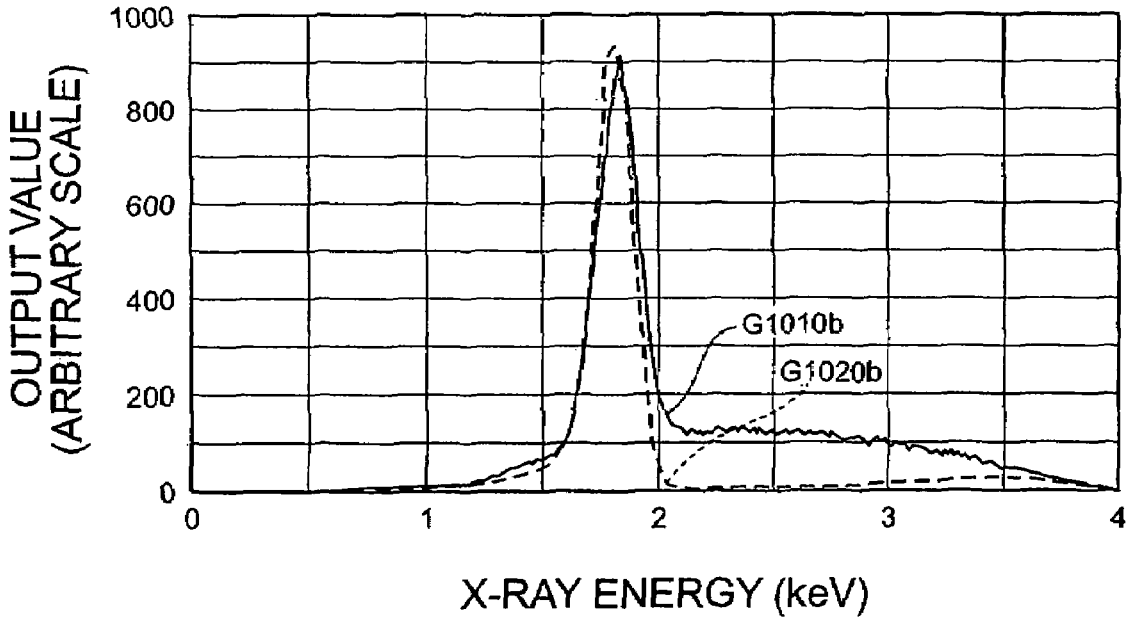

Next, FIG. 18 shows the X-ray spectrum of the X-ray tube to which the silicon foil having the thickness of 10 μm is applied as the transmission window material, and the X-ray spectrum of the X-ray tube to which beryllium having the thickness of 10 μm specially prepared for comparison is applied. In the area (a) shown in FIG. 18, aluminum having the thickness of 800 nm is applied as the X-ray target, and the operation voltage of each X-ray tube to which the silicon foil and beryllium are applied is 4 kV. In the area (a) shown in FIG. 18, a graph G1010*a* is the X-ray spectrum of the X-ray tube to which beryllium is applied as the transmission window material, and a graph G1020*a* is the X-ray spectrum of the X-ray tube to which the silicon foil is applied as the transmission window material. On the other hand, in the area (b) shown in FIG. 18, tungsten having the thickness of 200 nm is applied as the X-ray target, and the operation voltage of each X-ray tube to which the silicon foil and beryllium are applied is 4 kV. In the area (b) shown in FIG. 18, a graph G1010*b* is the X-ray spectrum of the X-ray tube to which the beryllium is applied as the transmission window material, and a graph G1020*b* is the X-ray spectrum of the X-ray tube to which the silicon foil is applied as the transmission window material.

As shown in the areas (a) and (b) of FIG. 18, since the X-ray transmission characteristics of the silicon play the role of the X-ray filter as it is in the X-ray tube to which the silicon foil is applied as the transmission window material, the X-rays of 2 keV to 4 keV are absorbed by the silicon transmission window, and the output spectrum only near 1.5 keV is extracted. That is, the silicon transmission window can cut the unnecessary high energy X-rays largely influencing the human body as compared with the conventional beryllium transmission window, and the X-rays suitable for the generation of ion gas can be alternatively extracted. Although the measurement is performed in a state where the interval between the transmission window (output window) of the X-ray tube and the X-ray detector is set to 10 mm, when the distance is set to 100 mm or more, the X-rays are attenuated, and cannot be detected due to the absorption (ionization) caused by the atmosphere.

Since the characteristic X-rays (1.48 keV) of aluminum can also be efficiently extracted in the atmosphere, the X-ray tube used for a fluorescence X-rays analysis device excited by the characteristic X-rays of, for example, aluminum and magnesium can be set to a closing type, and this can contribute to the miniaturization of the conventional device.

INDUSTRIAL APPLICABILITY

Since the present invention uses the silicon foil as the transmission window material instead of the harmful beryllium specified as the specification chemical substance as described above, the X-rays of low energy can be efficiently extracted without using harmful substances and the X-ray tube of low price is obtained. Since the silicon foil is directly affixed on the glass faceplate without using an adhesion material such as the brazing material, the X-ray tube having the structure having excellent durability is obtained. This kind of X-ray tube can also be used as not only the soft X-ray tube but also the X-ray tube having a tube voltage of tens of kilovolts or more, and can be incorporated in a great number of electronic equipment such as the static elimination device.

The invention claimed is:

1. An X-ray tube for emitting X-rays through a transmission window, comprising:

a closed vessel including an opening for defining said transmission window, said closed vessel having a glass faceplate which contains an alkaline ion, said glass faceplate having: a first major surface at least a part of which constitutes a part of a vacuum inner space of said closed vessel, a second major surface opposing said first major surface, and a through hole communicating between said first and second major surfaces;

an electron source, arranged in said closed vessel, for emitting electrons;

an X-ray target, arranged in a space defined by an inner wall of said through hole of said glass faceplate, receiving the electrons emitted from said electron source and generating the X-rays; and a silicon foil constituting said transmission window and having a thickness of 3 μm or more but 30 μm or less, said silicon foil being directly affixed on said glass faceplate by an anode bonding, while entirely covering one opening end of said through hole of said glass faceplate.

2. An X-ray tube according to claim 1, wherein a part of said silicon foil, which directly faces inside said closed vessel through said opening of said top part, is convexed toward the inside of said closed vessel.

3. An X-ray tube for emitting X-rays through a transmission window, comprising:

an electron source for emitting electrons;

an X-ray target for receiving the electrons emitted from said electron source and generating the X-rays;

a closed vessel accomodating at least said electron source and said X-ray target and including a single glass body which contains an alkaline ion, said single glass body being constituted by: a hollow part in which at least said electron source is arranged, and a top part which continues from said hollow part and has an opening for defining said transmission window;

a silicon foil constituting said transmission window and having a thickness of 3 μm or more but 30 μm or less, said silicon foil being directly affixed on an outer surface of said top part, while entirely covering said opening of said top part; and a protection electrode provided on a region including an edge of said opening of said top part, said region constituting at least a part of an inner surface of said top part which directly faces inside said closed vessel.

4. An X-ray tube according to claim 3, wherein said top part has a minimum outer diameter larger than a maximum outer diameter of said silicon foil.

5. An X-ray tube according to claim 3, wherein said silicon foil has a thickness of 3 μm or more but 10 μm or less.

6. An X-ray tube according to claim 3, wherein said top part has: a first major surface at least a part of which constitutes a part of a vacuum inner space of said closed vessel, a second major surface opposing said first major surface, and a through hole communicating between said first and second major surfaces and corresponding to said opening of said top part, and wherein said X-ray target is arranged in a space defined by an inner wall of said through hole of said top part.

7. An X-ray tube according to claim 3, wherein said opening of said top part has a mesh structure so that said transmission window is divided into a plurality of sections.

8. An X-ray tube according to claim 3, wherein said opening of said top part is composed by a plurality of through-holes, each corresponding to said transmission window.

9. An X-ray tube for emitting X-rays through a transmission window, comprising:

a closed vessel including an opening for defining said transmission window and having:

a glass main body which has an opening edge;

a metal flange attached on said opening edge of said main body and having an opening corresponding to or larger than said transmission window; and a glass faceplate having an opening which corresponds to said transmission window and has a maximum diameter smaller than a minimum diameter of said opening of said metal flange, at least a part of said glass faceplate being attached to said metal flange while the center of said opening of said glass faceplate corresponds to the center of said opening of said metal flange;

an electron source, arranged in said closed vessel, for emitting electrons;

an X-ray target, arranged in said closed vessel, receiving the electrons emitted from said electron source and generating the X-rays;

a silicon foil constituting said transmission window and having a thickness of 3 μm or more but 30 μm or less, said silicon foil being directly affixed on an outer surface of said glass faceplate, while covering said opening of said glass faceplate; and a protection electrode provided on a region including an edge of said opening of said glass faceplate, said region constituting at least a part of an inner surface of said glass faceplate which is directly exposed inside said closed vessel through said opening of said metal flange and opposes said outer surface of said glass faceplate.

10. An X-ray tube according to claim 9, wherein said glass faceplate contains an alkaline ion, and said silicon foil is directly affixed on said outer surface of said glass faceplate by an anodic bonding.

11. An X-ray tube according to claim 9, wherein said silicon foil has a thickness of 3 μm or more but 10 μm or less.

12. An X-ray tube according to claim 9, wherein said glass faceplate has: a first major surface at least a part of which constitutes a part of a vacuum inner space of said closed vessel, a second major surface opposing said first major surface, and a through hole which communicates between said first and second major surfaces and which corresponds to said opening of said glass faceplate, and wherein said X-ray target is arranged in a space defined by an inner wall of said through hole of said glass faceplate.

13. An X-ray tube according to claim 9, wherein said opening of said closed vessel has a mesh structure so that said transmission window is divided into a plurality of sections.

14. An X-ray tube according to claim 9, wherein said opening of said closed vessel is composed by a plurality of through-holes, each corresponding to said transmission window.

15. An X-ray tube according to claim 10, wherein said protection electrode is deposited on said inner surface of said glass faceplate which opposes an outer surface of said silicon foil and directly faces inside said closed vessel.

16. An X-ray tube according to claim 10, wherein said glass faceplate has a minimum outer diameter larger than a maximum outer diameter of said silicon foil.

17. An X-ray tube according to claim 10, wherein said glass faceplate has a sectional shape where a thickness of a peripheral part thereof is thinner than that of an inner side part thereof defining said transmission window.

* * * * *